US012669313B2

(12) United States Patent
Smith et al.

(10) Patent No.: US 12,669,313 B2
(45) Date of Patent: Jun. 30, 2026

(54) MAGAZINE FOR A CONDUCTED ELECTRICAL WEAPON

(71) Applicant: Axon Enterprise, Inc., Scottsdale, AZ (US)

(72) Inventors: Patrick Smith, Scottsdale, AZ (US); Magne Nerheim, Paradise Valley, AZ (US); Oleg Nemtyshkin, Scottsdale, AZ (US); Dubravko Zekanovic, Scottsdale, AZ (US)

(73) Assignee: AXON ENTERPRISE, INC., Scottsdale, AZ (US)

( * ) Notice: Subject to any disclaimer, the term of this patent is extended or adjusted under 35 U.S.C. 154(b) by 269 days.

(21) Appl. No.: 18/527,588

(22) Filed: Dec. 4, 2023

(65) Prior Publication Data

US 2026/0022916 A1 Jan. 22, 2026

Related U.S. Application Data

(63) Continuation of application No. 17/607,791, filed as application No. PCT/US2020/030717 on Apr. 30, 2020, now Pat. No. 11,867,481.

(Continued)

(51) Int. Cl.
*F41H 13/00* (2006.01)
*F42B 5/02* (2006.01)

(52) U.S. Cl.
CPC ..... *F41H 13/0025* (2013.01); *F42B 5/02* (2013.01)

(58) Field of Classification Search
CPC ..... F41H 13/0025

(Continued)

(56) References Cited

U.S. PATENT DOCUMENTS 2,926,566 A 3/1960 Atkins et al.
5,747,719 A 5/1998 Bottesch (Continued)

FOREIGN PATENT DOCUMENTS

CN 107328309 A 11/2017
CN 207351302 U 5/2018

(Continued)

OTHER PUBLICATIONS

International Searching Authority, International Search Report and Written Opinion for International Application No. PCT/US2020/014482 mailed Oct. 15, 2020.

(Continued)

*Primary Examiner* — Reginald S Tillman, Jr.
(74) *Attorney, Agent, or Firm* — Justin Powley

(57) ABSTRACT

A conducted electrical weapon may interchangeably receive a plurality of magazines. A magazine may be releasably engaged with a magazine bay of the conducted electrical weapon. Engagement of a magazine with the magazine bay may expose a bottom surface of the magazine. Each magazine may comprise a plurality of firing tubes. A magazine may be configured to launch at least one electrode from at least one firing tube of the plurality of firing tubes. A control circuit may be configured to provide an ignition signal to less than all of the plurality of firing tubes. A first pair of firing tubes may be oriented to achieve a minimum electrode spread at a first range. A second pair of firing tubes may be oriented to achieve a minimum electrode spread at a second range. The plurality of firing tubes may be arranged in an array comprising a column of firing tubes.

20 Claims, 12 Drawing Sheets

Related U.S. Application Data

(60) Provisional application No. 62/887,137, filed on Aug. 15, 2019, provisional application No. 62/840,575, filed on Apr. 30, 2019.

(58) Field of Classification Search
USPC ..... 42/1.08
See application file for complete search history.

(56) References Cited

U.S. PATENT DOCUMENTS

| | | | |
|---|---|---|---|
| 5,831,199 | A | 11/1998 | Mcnulty, Jr. et al. |
| 6,575,073 | B2 | 6/2003 | McNulty, Jr. et al. |
| 6,877,434 | B1 | 4/2005 | Mcnulty, Jr. |
| 7,950,176 | B1 | 5/2011 | Nemtyshkin et al. |
| 7,950,329 | B1 | 5/2011 | Nemtyshkin et al. |
| 8,342,098 | B2 | 1/2013 | Shalev et al. |
| 10,168,127 | B1 | 1/2019 | Salisbury et al. |
| 10,598,467 | B1 | 3/2020 | Mcdermit et al. |
| 2006/0120009 | A1 | 6/2006 | Chudy |
| 2006/0207466 | A1 | 9/2006 | Mcnulty et al. |
| 2006/0225333 | A1 | 10/2006 | Park |
| 2007/0070574 | A1 | 3/2007 | Nerheim et al. |
| 2010/0050856 | A1 | 3/2010 | Baldwin |
| 2010/0132238 | A1 | 6/2010 | Werner et al. |
| 2010/0275806 | A1 | 11/2010 | Gavin et al. |
| 2012/0037702 | A1 | 2/2012 | Kude |
| 2012/0262293 | A1 | 10/2012 | Brave et al. |
| 2014/0098453 | A1 | 4/2014 | Brundula et al. |
| 2015/0002981 | A1 | 1/2015 | Klug et al. |
| 2017/0059661 | A1 | 3/2017 | Foldyna |
| 2018/0259303 | A1 | 9/2018 | Nerheim et al. |
| 2018/0283829 | A1 | 10/2018 | Petrovic et al. |
| 2019/0128650 | A1 | 5/2019 | Kim |
| 2020/0109933 | A1 | 4/2020 | Brundula et al. |

FOREIGN PATENT DOCUMENTS

| | | | |
|---|---|---|---|
| CN | 108444337 | A | 8/2018 |
| KR | 101890759 | B1 | 3/2018 |
| KR | 101872709 | B1 | 7/2018 |
| RU | 2275576 | C1 | 4/2006 |
| RU | 68671 | U1 | 11/2007 |
| RU | 2351871 | C1 | 4/2009 |
| RU | 2477441 | C1 | 3/2013 |
| RU | 2480704 | C2 | 4/2013 |
| RU | 2526159 | C2 | 8/2014 |
| RU | 2527242 | C2 | 8/2014 |
| RU | 2648562 | C1 | 3/2018 |
| RU | 2748738 | C1 | 5/2021 |
| WO | 2009025575 | A1 | 2/2009 |
| WO | 820090025575 | A1 | 2/2009 |

OTHER PUBLICATIONS

International Searching Authority, International Search Report and Written Opinion for International Application No. PCT/US2020/030717 mailed Jan. 20, 2021.

Israel Patent Office (ILPO), Notice of Deficiencies for Israel Patent Application 287697, mailed Sep. 29, 2024.

European Patent Office, Extended European Search Report for European Application No. 20834888.8 mailed Dec. 15, 2022.

United States Patent and Trademark Office, Advisory Action for U.S. Appl. No. 17/344,802 mailed Jan. 24, 2023.

United States Patent and Trademark Office, Non-Final Office Action for U.S. Appl. No. 17/344,802 mailed Apr. 20, 2022.

United States Patent and Trademark Office, Non-Final Office Action for U.S. Appl. No. 17/344,802 mailed Mar. 7, 2023.

United States Patent and Trademark Office, Final Office Action for U.S. Appl. No. 17/344,802 mailed Oct. 14, 2022.

Canadian Intellectual Property Office, Office Action for Canadian Application No. 3,138,557 mailed Mar. 6, 2024.

MAGAZINE FOR A CONDUCTED ELECTRICAL WEAPON

CROSS-REFERENCE TO RELATED APPLICATIONS

This application is a continuation of, and claims priority to and the benefit of, U.S. application Ser. No. 17/607,791, filed on Oct. 29, 2021, and entitled "POLYMORPHIC CONDUCTED ELECTRICAL WEAPON"; which was a national stage application filed under 35 U.S.C. § 371 and claimed priority to and the benefit of, International Patent Application PCT/US2020/030717, filed on Apr. 30, 2020, and entitled "POLYMORPHIC CONDUCTED ELECTRICAL WEAPON"; which claimed priority to and the benefit of U.S. Provisional Application 62/887,137, filed on Aug. 15, 2019, and entitled "POLYMORPHIC CONDUCTED ELECTRICAL WEAPON", and U.S. Provisional Application 62/840,575, filed on Apr. 30, 2019, and entitled "POLYMORPHIC CONDUCTED ELECTRICAL WEAPON APPARATUS". This application is further related to U.S. application Ser. No. 17,344,802, filed on Jun. 10, 2021, and entitled "POLYMORPHIC CONDUCTED ELECTRICAL WEAPON"; and U.S. application Ser. No. 16/748,132, now U.S. Pat. No. 11,041,698, filed on Jan. 21, 2020, and entitled "UNITARY CARTRIDGE FOR A CONDUCTED ELECTRICAL WEAPON". The above-referenced applications are incorporated by reference in their entirety.

FIELD OF INVENTION

Embodiments of the present invention relate to conducted electrical weapons.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of this disclosure may relate to a conducted electrical weapon, comprising a conducted electrical weapon body that includes a handle portion at a first end configured to be grasped by a hand of a user. The conducted electrical weapon may also include an upper member extending in a substantially front-to-rear direction from the handle portion to a second end opposite the first end. The conducted electrical weapon may further include a magazine bay positioned beneath the upper member, a trigger positioned between the handle portion and the magazine bay, and a power source engaged with the body. A magazine may include a plurality of firing tubes, where the magazine is releasably engaged with the magazine bay. Each firing tube may be configured to engage at least one electrode.

Implementations of the conducted electrical weapon may include where the magazine engages with the magazine bay by sliding in the substantially front-to-rear direction, or in some instances, the magazine engages with the magazine bay by sliding in a substantially top-to-bottom direction. The magazine may be configured to launch at least one electrode from at least one firing tube of the plurality of firing tubes. The conducted electrical weapon body may include at least one of a positional sensor and an environmental sensor. The conducted electrical weapon body may include the positional sensor, where the positional sensor is one of an accelerometer, a gyroscope, and a magnetometer. The conducted electrical weapon may be configured to launch at least one electrode from at least one firing tube of the plurality of firing tubes based on data provided from the at least one of the positional sensor and the environmental sensor. The magazine may include a top surface, a bottom surface opposite the top surface, a rear surface extending between the top surface and the bottom surface, a front surface extending between the top surface and the bottom surface, where the front surface includes the plurality of firing tubes. The magazine may comprise nine firing tubes, where the nine firing tubes are arranged in an array of three rows and three columns in a front surface of the magazine. In addition, each firing tube of the plurality of firing tubes along a top row may have an axis that may be substantially parallel with an axis defined by rear sights and forward sights of the conducted electrical weapon body. In some embodiments, each firing tube along a bottom row has an axis that is arranged at an acute angle with the axis of the firing tube along the top row. Each firing tube of at least three firing tubes of the plurality of firing tubes along a first column may have a longitudinal axis intersecting a common plane.

Another aspect of this disclosure may relate to a conducted electrical weapon comprising: a conducted electrical weapon body with a handle portion at a first end of the body configured to be grasped by a hand of a user, an upper member extending in a front-to-rear direction from the handle portion to a second end of the body opposite the first end, and a magazine bay positioned beneath the upper member, where the magazine bay includes an opening that extends from a portion of the second end of the body onto a bottom side of the body. The conducted electrical weapon body may also include a trigger positioned between the handle portion and the magazine bay. A magazine may releasably engage an opening of the magazine bay. The magazine may have a top surface, a bottom surface opposite the top surface, a rear surface extending between the top surface and the bottom surface, a front surface extending between the top surface and the bottom surface, a first side surface extending between the front surface and the rear surface, and a second side surface extending between the front surface and the rear surface opposite the first side surface, where the front surface includes the plurality of firing tubes. The first side surface of the magazine may include an alignment guide, where the alignment guide has a surface recessed below the first side surface. Insertion of the magazine into the opening of the magazine bay may expose the bottom surface of the magazine.

Still other aspects of this disclosure may relate to a conducted electrical weapon kit, comprising a conducted electrical weapon body that may include a handle portion at a first end of the conducted electrical weapon body configured to be grasped by a hand of a user. The conducted electrical weapon kit may also an upper member extending in a front-to-rear direction from the handle portion to a second end of the conducted electrical weapon body opposite the first end. The conducted electrical weapon body may also include a magazine bay positioned beneath the upper member, and a trigger positioned between the handle portion and the magazine bay, where the magazine bay has an opening that extends from a portion of the second end of the conducted electrical weapon body onto a bottom side of the conducted electrical weapon body. The conducted electrical weapon kit may also include a first magazine configured to be releasably engaged with the magazine bay, where the first magazine comprises a first plurality of firing tubes, where each firing tube of the first plurality of firing tubes is configured to engage at least one electrode. The conducted electrical weapon kit may also include a second magazine configured to be releasably engaged with the magazine bay, where the second magazine comprises a second plurality of firing tubes, where the second magazine is configured to releasably engage with the magazine bay.

Other elements of this disclosure may relate to a conducted electrical weapon kit where the second plurality of firing tubes is greater than the first plurality of firing tubes. The first plurality of firing tubes are arranged in an array with a plurality of rows and a plurality of columns on a front surface of the first magazine. The conducted electrical weapon body may further comprise a processor, where the processor communicates with the first magazine to receive data about the first magazine when the first magazine is engaged with the magazine bay, and where the processor communicates with the second magazine to receive data about the second magazine when the second magazine is engaged with the magazine bay.

Still other aspects of this disclosure may also relate to a cartridge for a conducted electrical weapon comprising: a cartridge body having a first end, a second end opposite the first end, a cylindrical outer surface extending between the first end and the second end, and a hollow inner portion; a frangible end cap attached to the first end of the cartridge body; an electrode positioned in the hollow inner portion, wherein the electrode includes an electrode body and a spear, where the electrode body includes a first end and a second end opposite the first end. The spear may extend from the first end of the electrode body. The cartridge may further include a piston positioned adjacent the second end of the electrode body. The cartridge may have a propulsion module positioned such that the piston is located between the electrode body and the propulsion module. The cartridge may also have a wad positioned adjacent the piston, where the wad is located between the propulsion module and the piston.

Implementations of the cartridge for the conducted electrical weapon may include a cartridge body where the hollow inner portion includes a first inner portion having a first diameter, a second inner portion having a second diameter, and a piston stop positioned a predetermined first distance from the first end of the cartridge body, where the first diameter may be smaller the second diameter, and where the piston stop may be configured to directly contact the piston. The piston may be configured to travel a predetermined second distance in the hollow inner portion, where the predetermined second distance is less than the predetermined first distance. In some embodiments, the propulsion module may further include a pyrotechnic material and a conductor disposed through the propulsion module and the pyrotechnic material. The cartridge may further comprise a propulsion module contact positioned adjacent the propulsion module where the propulsion module contact may be configured to transmit an electrical signal from the conducted electrical weapon to the conductor causing the conductor to heat up and ignite the pyrotechnic material. In other embodiments, the cartridge may further comprise a cap with an opening positioned at the second end of the cartridge body, where the cap seals against the cartridge body and the opening surrounds a portion of the propulsion module contact. The wad may fully isolate the piston from the propulsion module. The wad may contact the inner walls of the hollow inner portion, thereby establishing a seal with the inner walls of the hollow inner portion. The frangible end cap of the cartridge may seal against the cartridge body and surround a portion of the first end of the cartridge body.

Other attributes of this disclosure may relate to a cartridge for a conducted electrical weapon comprising: a cartridge body configured to engage a firing tube of a provided magazine, the cartridge body having a first end, a second end opposite the first end, a cylindrical outer surface extending between the first end and the second end, and a hollow inner portion; an electrode positioned in the hollow inner portion, where the electrode includes an electrode body and a spear. The electrode body may include a first end and a second end opposite the first end, where the spear extends from the first end of the electrode body. The cartridge may also include a piston positioned adjacent the second end of the electrode body and a propulsion module positioned such that the piston is between the electrode body and the propulsion module. When the propulsion module is ignited, the piston may be propelled forward causing the electrode to be propelled out of the first end of the cartridge body.

Further implementations of the cartridge may have a cartridge body where the hollow inner portion includes a first inner portion having a first diameter, a second inner portion having a second diameter, and a piston stop positioned a predetermined distance of at least 10 millimeters from the first end of the cartridge body, where the first diameter may be smaller than the second diameter, and where the piston stop is a shelf that extends from the first diameter to the second diameter. The cartridge may further comprise a propulsion module contact that contacts the propulsion module, a pyrotechnic material inside the propulsion module, and a conductor within the propulsion module, where the propulsion module contact is configured to transmit an electrical signal from a conducted electrical weapon to the conductor within the propulsion module, thereby causing the conductor to heat up and ignite the pyrotechnic material inside the propulsion module. The piston may be configured to travel a predetermined second distance in the hollow inner portion, where the predetermined second distance is less than the predetermined first distance, and the predetermined second distance is at least half the predetermined first distance. In some embodiments, the cartridge may further comprise an end cap attached to the first end of the cartridge body, where the end cap encloses the first end of the cartridge body. The cartridge may further comprise a wad positioned adjacent the piston, where the wad is located between the propulsion module and the piston. The wad may fill the hollow inner portion between the piston and the propulsion module.

Yet other aspects of this disclosure may relate to a cartridge for a conducted electrical weapon comprising: a cartridge body having a first end, a second end opposite the first end, a cylindrical outer surface extending between the first end and the second end, and a hollow inner portion, where the hollow inner portion includes a first inner portion having a first diameter, a second inner portion having a second diameter, and a piston stop positioned a predetermined distance from the first end. The first diameter may be smaller than the second diameter, where the piston stop is a shelf that extends from the first diameter to the second diameter. An electrode may be positioned in the hollow inner portion, where the electrode includes an electrode body and a spear. The electrode body may include a first end and a second end opposite the first end, where the spear extends from the first end of the electrode body. The cartridge may include a wire tether that is stored inside the electrode body. The cartridge may further include a piston positioned adjacent the second end of the electrode body, where the piston is electrically coupled to one end of the wire tether. The cartridge may also have a propulsion module positioned such that the piston is between the electrode body and the propulsion module. The cartridge may also a propulsion module contact positioned adjacent the propulsion module. A wad may be positioned adjected the piston, where the wad is located between the propulsion module and the piston. The propulsion module may be ignited by a low voltage electrical signal received via the propulsion module contact, and the piston may be propelled forward causing the electrode to be propelled out of the first end of the cartridge body.

The cartridge may further comprise a cap positioned at the first end of the cartridge body, where the cap seals against the cartridge body and encloses the first end of the cartridge body. Lastly, the cartridge may be configured to insert into a firing tube of a magazine, where the magazine engages the conducted electrical weapon.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which.

DETAILED DESCRIPTION

Figure 1A:
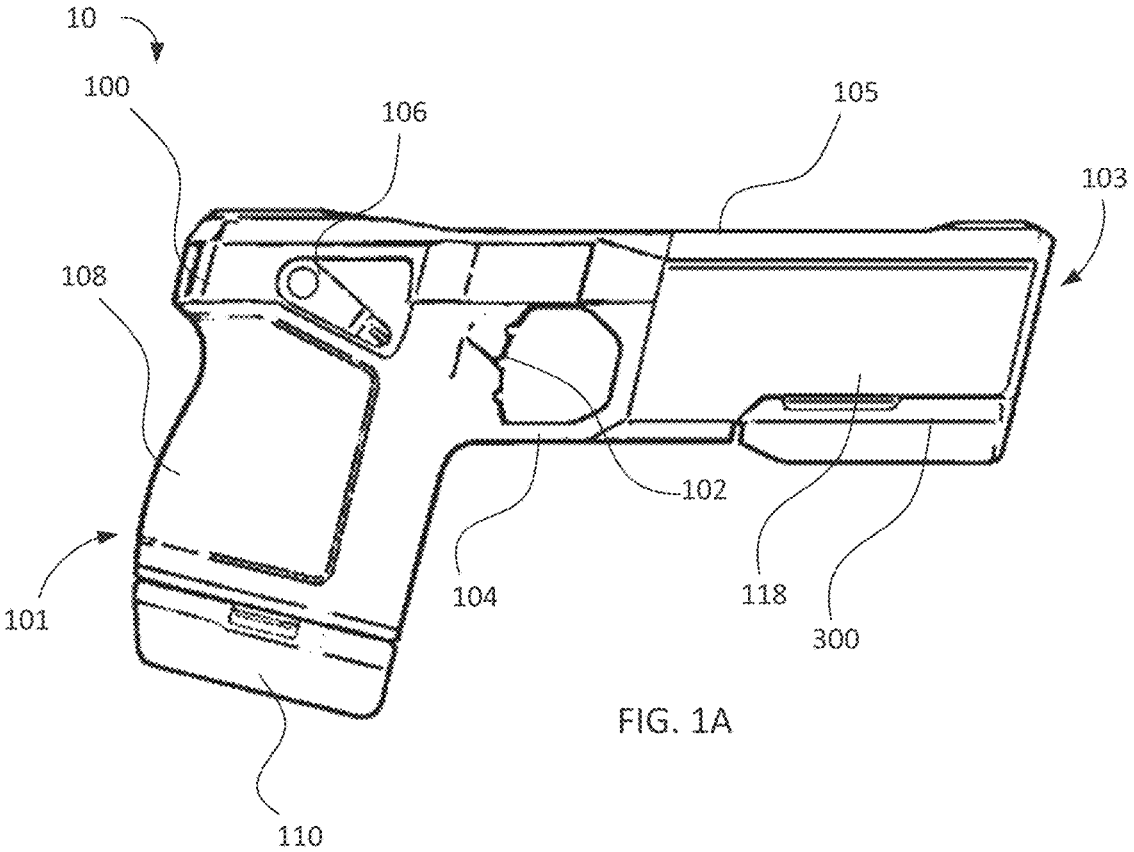
FIG. 1A illustrates a side view of a conducted electrical weapon system with a magazine engaged according to one or more aspects described herein.
Figure 1B:
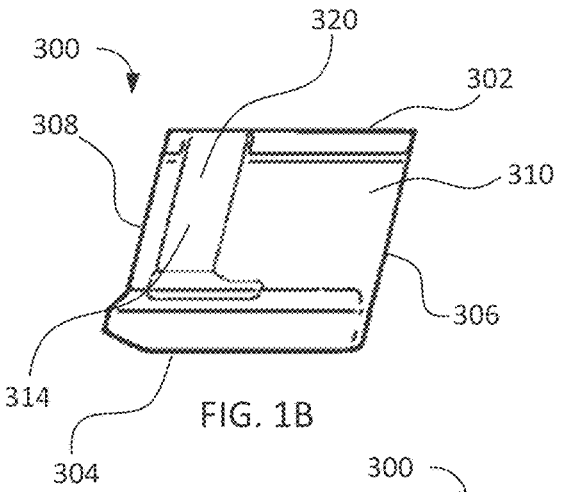
FIG. 1B illustrates a side view of the magazine of the conducted electrical weapon system illustrated in FIG. 1A according to one or more aspects described herein.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Nothing in this specification should be construed as requiring a specific three-dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

The term "include" and variations of the word, such as "including" and "includes" is not intended to exclude other additives, components, integers or steps.

The term "substantially parallel" means that a first line, segment, plane, edge, surface, etc. is approximately (in this instance, within 2%) equidistant from with another line, plane, edge, surface, etc., over at least 50% of the length of the first line, segment, plane, edge, surface, etc.

Additionally, the term "plurality," as used herein, indicates any number greater than one, either disjunctively or conjunctively, as necessary, up to an infinite number.

Reference throughout this specification to "an embodiment" or "some embodiments" means that a particular feature, structure or characteristic described in connection with the embodiment is included in at least one embodiment of the present invention. Thus, appearances of the phrases "in an embodiment" or "in some embodiments" in various places throughout this specification are not necessarily all referring to the same embodiment.

A conducted electrical weapon ("CEW") provides a stimulus signal to a human or animal target to impede locomotion of the target. Locomotion may be inhibited by interfering with voluntary use of skeletal muscles and/or causing pain in the target. A stimulus signal that interferes with skeletal muscles may cause the skeletal muscles to lockup (e.g., freeze, tighten, stiffen) so that the target may not voluntarily move. A CEW may include wire tethered electrodes (e.g., darts) that are launched from its housing by a propellant toward a target. A CEW may provide (e.g., apply) a stimulus signal through a target while the launched electrodes mechanically and/or electrically couple to tissue of the target. The CEW may provide a current through the target via a circuit that includes a filament (e.g., wire-tether) coupled to a first electrode connected to the target, and a second electrode connected to the target and coupled to a second filament back to the CEW. The wire-tethered electrodes may be packaged in individual deployment units (e.g., cartridges). A cartridge may be inserted into the CEW to perform the functions of launching the electrodes and delivering the stimulus signal.

The range of a CEW that delivers a stimulus signal via wire-tethered electrodes may be limited by the length of the wire tethers. In the case of a hand-held CEW, the wire tethers extend from the device to the electrodes as they strike the target so that the stimulus signal from the signal generator (within the device) can travel through the wire tethers to and through the target. Because a user generally holds the handle while operating the CEW, the range of the CEW from the user to the target is limited by the length of the wire-tethers.

The ability of a stimulus signal to lockup the skeletal muscles of a target increases with the distance between the electrodes that deliver the stimulus signal through the target. A greater distance between electrodes provides the stimulus signal through more target tissue thereby increasing the likelihood of neuromuscular incapacitation. Neuromuscular incapacitation ("NMI") refers to the rigid state (e.g., lockup) induced in skeletal muscles by the stimulus signal. Lockup of the skeletal muscles inhibits (e.g., interferes with) voluntary operation of skeletal muscles by the target. Lockup deprives a target of voluntary use of skeletal muscles. Because skeletal muscles control the movement of limbs, lockup interferes with voluntary movement of the target. A spacing (e.g., spread, separation) of at least seven inches (17.8 centimeters) between electrodes enables the stimulus signal to travel through at least seven inches of target tissue, which increases the likelihood of skeletal muscle lockup. Providing a stimulus signal through the target where the electrodes are spaced within a range between 6 inches and 12 inches (15.2 centimeters and 30.5 centimeters), preferably 12 inches, from each other increases a likelihood that the stimulus signal will result in neuromuscular incapacitation.

Providing a stimulus signal through electrodes that are spaced less than 6 inches apart on the target, and at times depending on the location where the electrodes couple to the target less than 12 inches apart, may not cause NMI. Electrodes that are spaced on the target less than 6 inches apart, or at times less than 12 inches apart, may not provide a stimulus signal through enough target tissue to induce lockup of skeletal muscles. However, even if a stimulus signal does not result in lockup of skeletal muscles, the stimulus signal through target tissue may cause pain in the target. As a result of the pain, a target may voluntarily decide to limit their movement (e.g., locomotion) thereby interfering with locomotion of the target.

Knowing the distance from the CEW to the target enables the CEW to determine a likely effect of the stimulus signal on the target and can help the CEW determine the proper electrode to fire at the target. For example, depending upon which magazine is installed in the CEW and the distance to the target, the CEW may determine to fire a first electrode in a first direction and a second electrode in a second direction to achieve the optimal spacing when the electrodes strike the target such that skeletal muscle lockup can be achieved when a stimulus signal is applied.

In general, this disclosure relates to a CEW system that can interchangeably receive a plurality of magazines, which can each hold a plurality of cartridges. For instance, each magazine may hold at least four cartridges, or in some instances, each magazine may hold as many as 18 or more cartridges. The magazines may be interchangeably received by the body or housing of the weapon system, such that the CEW system may have multiple configurations. The body of the weapon system may be able to detect which magazine is installed such that it can operably determine the appropriate cartridges to fire to effectively target and disable the target.

The conducted electrical weapon (CEW) 10 may include a weapon body or housing 100 that includes a handle or grip portion 108 configured to be grasped by a hand of a user at a first end 101, or rear, of the body 100, an upper member 105 extending in a substantially front-to-rear direction from the handle portion 108 to a second end 103, or front, of the body 100 opposite the first end 101 as shown in FIG. 1A. The body 100 may include a magazine bay 118 configured to releasably receive a magazine 300. The body 100 may include an activation input configured to receive a mechanical and/or electrical signal such as from trigger 102. The trigger 102 may be positioned between the handle portion 108 and the magazine bay 118. A trigger guard 104 and a safety mechanism, such as a safety switch 106, may be included on the body 100 to help prevent an accidental discharge of the weapon. The body 100 may further comprise aiming aids such as rear iron sights 112 and front iron sights 114, laser spot indicators, and/or LED illuminators, which may be aligned to form an axis 115 along the body 100. In addition, the body 100 may include a power source 110 to energize the weapon, which may be either permanently or releasably engaged with the body 100. The body 100 may further include a magazine release mechanism configured to eject a magazine 300 or disengage the magazine 300 from the magazine bay 118. A magazine release button 116 may be positioned along the upper member 105 above the magazine bay 118, such that when depressed, the magazine release mechanism ejects the magazine 300.

A magazine bay 118 of a body 100 may be configured to releasably receive a magazine, such as magazine 300. In various embodiments, the magazine bay 118 may be configured to interchangeably receive magazines having different properties (e.g., number of electrodes, orientation of firing tubes, etc.). The magazine bay 118 may be positioned beneath the upper member 105. The magazine bay 118 may be sized and shaped to engage a portion of a magazine 300.

A shape of magazine bay 118 may complement a shape of magazine 300 to accommodate magazine 300.

In various embodiments, the magazine bay 118 may include an opening that extends from a portion of the second end 103 of the body 100 onto a bottom side 107 of the body 100. A volume of the magazine bay 118 may be a volume defined by the intersection of the opening of the magazine bay 118 and internal surfaces of body 100 adjacent the magazine bay 118, wherein the internal surfaces define a boundary of the magazine bay 118 within the body 100. A volume of the magazine bay 118 may be less than a volume of a magazine 300, wherein a volume of a magazine 300 may be defined within the external surfaces of magazine 300. For example, the volume of magazine bay 118 may be between 5% and 25% of the volume of magazine 300, between 25% and 50% of the volume of magazine 300, between 50% and 75% of the volume of magazine 300, or between 75% and 99%, of the volume of magazine 300, according to various aspects described herein.

A magazine 300 may be releasably engaged with the magazine bay 118 of the body 100. The magazine 300 may include a plurality of firing tubes 316 (e.g., bores, silos, chambers, etc.), where each firing tube 316 is configured to secure at least one cartridge 200 as shown in FIGS. 1B-1E. The plurality of firing tubes 316 may be integrated into the magazine, wherein magazine 300 fixedly interconnects individual firing tubes of the plurality of firing tubes 316. In various embodiments, the magazine 300 may include at least three firing tubes 316. In addition, the magazine 300 may be configured to launch the electrode 212 housed in each of the cartridges 200 installed in each of the plurality of firing tubes 316. The magazine 300 may engage the magazine bay 118 by sliding in a substantially front-to-rear direction (in a direction from the second end 103 towards the first end 101), or by sliding in a substantially top-to-bottom direction (in a direction towards the upper member 105). In other words, the magazine 300 may engage magazine bay 118 by sliding in a direction perpendicular to axis 115, or by sliding in a direction parallel to axis 115. In some embodiments, magazine 300 may engage the magazine bay 118 by sliding in a combination of a front-to-rear direction and a top-to-bottom direction. That is, magazine 300 may engage the magazine bay 118 by sliding in a front and top to rear and bottom direction. In other words, magazine 300 may engage the magazine bay 118 by sliding in a direction oblique to axis 115.

In various embodiments, magazine 300 may couple the plurality of firing tubes 316 at fixed positions relative to body 100. Magazine 300 may engage magazine bay 118 in a fixed manner. Magazine 300 and the plurality of firing tubes 316 may not move (e.g., be repositioned, rotate, translate, slide, etc.) relative to body 100 upon engagement of magazine 300 with magazine bay 118. The position of the plurality of firing tubes 316 relative body 100 may be preserved, including between launch of electrodes from different sets of firing tubes of the plurality of firing tubes 316. By engaging magazine bay 118 in the fixed manner, operation of magazine 300 may be simplified and each firing tube of the plurality of firing tubes 316 may be oriented for launch of a respective electrode upon engagement of the magazine 300 with magazine bay 118.

The magazine 300 may include a top surface 302, a bottom surface 304 opposite the top surface 302, a rear surface 308 extending between the top surface 302 and the bottom surface 304, and a front surface 306 extending between the top surface 302 and the bottom surface 304. The front surface 306 may include a plurality of firing tubes 316. The bottom surface 304 of the magazine 300 may be exposed when the magazine 300 is inserted into the opening of the magazine bay 118. In various embodiments, a portion of the bottom surface 304 may be exposed when magazine 300 is inserted into the opening of the magazine bay 118. Engagement (e.g., insertion) of the magazine 300 with body 100 may expose at least a portion of the bottom surface 304. A first side surface 310 may extend from the top surface 302 and the bottom surface 304 between the front and rear surfaces 306, 308, and a second side surface 312 may extend from the top surface 302 and the bottom surface 304 between the front and rear surfaces 306, 308 opposite the first side surface 310. Portions of the side surfaces 310, 312 may include a taper (e.g., chamfer) such that the bottom surface 304 is narrower than the top surface 302 to make it easier for a user to grasp the bottom of the magazine 300. Portions of the side surfaces 310, 312 may be textured, knurled, contoured, depressed, or otherwise modified to provide a tactile interface for the user to grasp. The magazine 300 may include an alignment guides, or slides 314, positioned on the first side surface 310 and second side surface 312 that engage engaging members positioned along the sides of the magazine bay 118 to align and secure the magazine 300 to the body 100. Each alignment guide 314 may longitudinally extend in a direction of which the magazine 300 is configured to engage the body 100. Each alignment guide 314 may include a recess 320 positioned below its respective side surface 310, 312. In various embodiments, each alignment guide 314 may include a protrusion positioned above its respective side surface 310, 312. In some embodiments, each alignment guide 314 may include one of a recess and a protrusion configured to cooperate with a respective surface in the magazine bay 118.

A longest dimension of magazine 300 may be a length between the front surface 306 and the rear surface 308. The length between the front surface 306 and the rear surface 308 may be between one inch and two inches (2.5 centimeters to 5.8 centimeters), between two inches and three inches (5.8 centimeters and 7.6 centimeters), between three inches and four inches (7.6 centimeters and 10.2 centimeters), or between one inch and four inches (2.5 centimeters and 10.2 centimeters), according to various aspects of the present disclosure.

Each firing tube 316 may be configured to secure a cartridge, or unitary cartridge, 200 and then launch the electrode 212 from the cartridge 200 independently from its corresponding firing tube 316. Each firing tube 316 may extend longitudinally between a rear firing tube end 305 and a front firing tube end 307. A longest dimension of each firing tube 316 may be a length, such as firing tube length LA, between the rear firing tube end 305 and the front firing tube end 307. In various embodiments firing tube length LA may be equal to the length of magazine 300, wherein the rear firing tube end 305 is contiguous with the rear surface 308, and the front firing tube end 307 is contiguous with the front surface 306, thereby forming a passage therethrough. In other words, each of front surface 306 and rear surface 308 may comprise a respective opening of firing tube 316. In other embodiments, each firing tube 316 may be contiguous with only the front surface 306 of the magazine 300. In other words, the front firing tube end 307 may be conterminous with the front surface 306 of the magazine 300, such that magazine 300 comprises an opening of firing tube 316. In various embodiments, each firing tube 316 may be contiguous with at least the front surface 306 of the magazine 300.

In various embodiments, each firing tube 316 may be in fluid communication with an environment external to magazine 300.

In various embodiments, each firing tube 316 may comprise an internal surface defining a cavity. A cross section of each firing tube 316 may comprise a circle, an elliptical, a polygon, or any other suitable shape configured to receive a unitary cartridge 200. For example, each firing tube 316 may comprise a cylindrical shape extending longitudinally between the front firing tube end 307 and the rear firing tube end 305. In that regard, each firing tube 316 may comprise a longitudinal axis, about which it extends. Each firing tube 316 may comprise radial symmetry about the longitudinal axis.

In various embodiments, a maximum width of firing tube 316 may be a diameter, such as firing tube diameter D3 of firing tube 316. The diameter of each firing tube 316 may be selected to receive unitary cartridge 200. In various embodiments, an inner diameter D3 of firing tube 316 may be sized to cooperate with an outer diameter of unitary cartridge 200, such as outer diameter D4 (with brief reference to FIG. 4A). For example, inner diameter D3 may be equal to or greater than outer diameter D4. In that regard, unitary cartridge 200 may slip into firing tube 316 in a slip-fit manner. For example, inner diameter D3 may equal to outer diameter D4, 0.001 inches (0.003 centimeters) greater than outer diameter D4, 0.002 inches (0.005 centimeters) greater than outer diameter D4, 0.003 inches (0.008 centimeters) greater than outer diameter D4, or any other suitable size to receive unitary cartridge 200 with minimal friction. In some embodiments, inner diameter D3 of firing tube 316 may be less than outer diameter D4 of unitary cartridge 200. For example, unitary cartridge 200 may be press-fit (e.g., interference fit) into firing tube 316 to secure unitary cartridge 200 within firing tube 316. In that regard, a press-fit may prevent unitary cartridge 200 from cyclically slipping within firing tube 316. For example, inner diameter D3 may be 0.001 inches (0.003 centimeters) less than outer diameter D4, 0.002 inches (0.005 centimeters) less than outer diameter D4, 0.003 inches (0.008 centimeters) less than outer diameter D4, or any other suitable size to receive unitary cartridge 200 with maximal friction.

In various embodiments, inner diameter D3 of firing tube 316 may be constant about its length from front firing tube end 307 to rear firing tube end 305. In some embodiments, in diameter D3 may vary (e.g., taper) about the length of firing tube 316. For example, front firing tube end 307 may comprise a larger or smaller diameter than rear firing tube end 305. In that regard, the smaller diameter of firing tube 316 may be configured to cooperate with a unitary cartridge 200 to limit translation of unitary cartridge 200 in a direction along the longitudinal axis of firing tube 316. In some embodiments, firing tube 316 may comprise a shelf (e.g., step, stop, etc.) protruding from the inner surface. As another example, front firing tube end 307 may comprise an opening having a diameter less than outer diameter D4 of unitary cartridge 200. For example, firing tube 316 may comprise a shelf adjacent front firing tube end 307, where a diameter of the shelf may be less than a diameter of rear firing tube end 307. In that regard, the shelf may be configured to limit translation of a unitary cartridge 200 in a direction along the longitudinal axis of firing tube 316 and toward front firing tube end 307. A direction of movement of each unitary cartridge 200 and electrode 212 may be constrained to the longitudinal axis of its corresponding firing tube 316.

Each firing tube 316 performs the functions similar to that of a barrel of a firearm. The orientation of the firing tube 316 may determine a direction of flight (e.g., trajectory) of the electrode. The firing tubes 316 may be grouped as a pattern such as an array comprising a plurality of rows and columns when looking at the front surface 306 of the magazine 300. In various embodiments, the firing tubes 316 may be arranged in a circular pattern, a triangular pattern, a staggered (e.g., offset) pattern, or any other suitable pattern configured to minimize a footprint of the firing tubes 316 on the front surface 306 of magazine 300. In various embodiments, the firing tubes 316 may be arrange in a pattern to maximize a number of firing tubes 306 in a volume of a magazine 300.

Figure 1C:
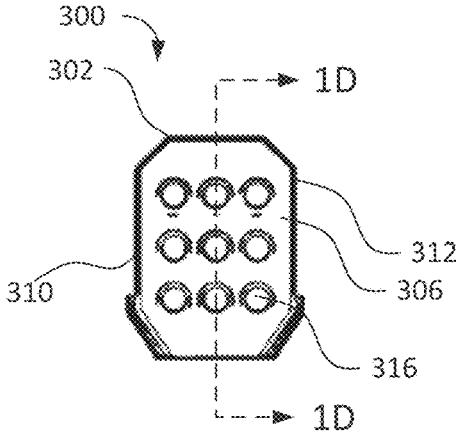
FIG. 1C illustrates a front view of the magazine of FIG. 1B according to one or more aspects described herein.
Figure 1D:
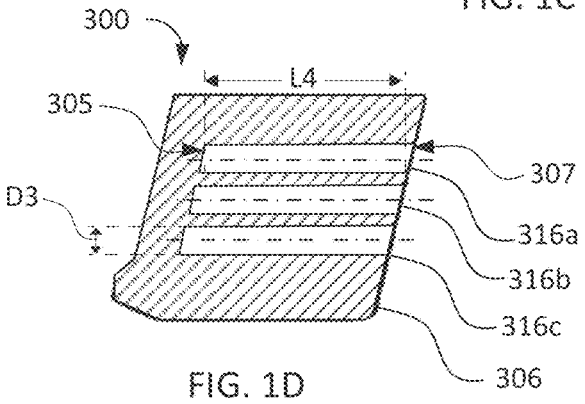
FIG. 1D illustrates a side cross-sectional view of the magazine of FIG. 1B according to one or more aspects described herein.
Figure 1E:
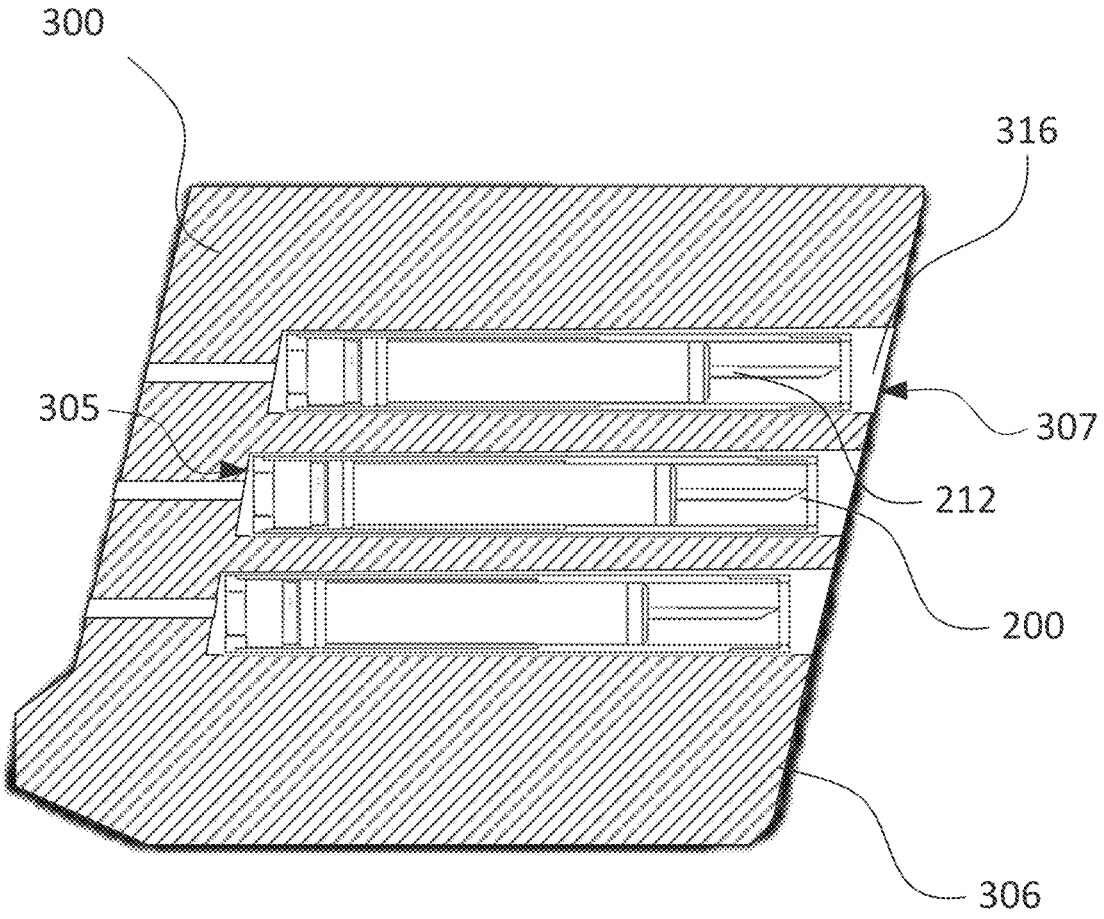
FIG. 1E illustrates a side cross-sectional view of the magazine of FIG. 1B with a plurality of unitary cartridges of FIGS. 3A-3C installed in the magazine according to one or more aspects described herein.
Figure 2A:
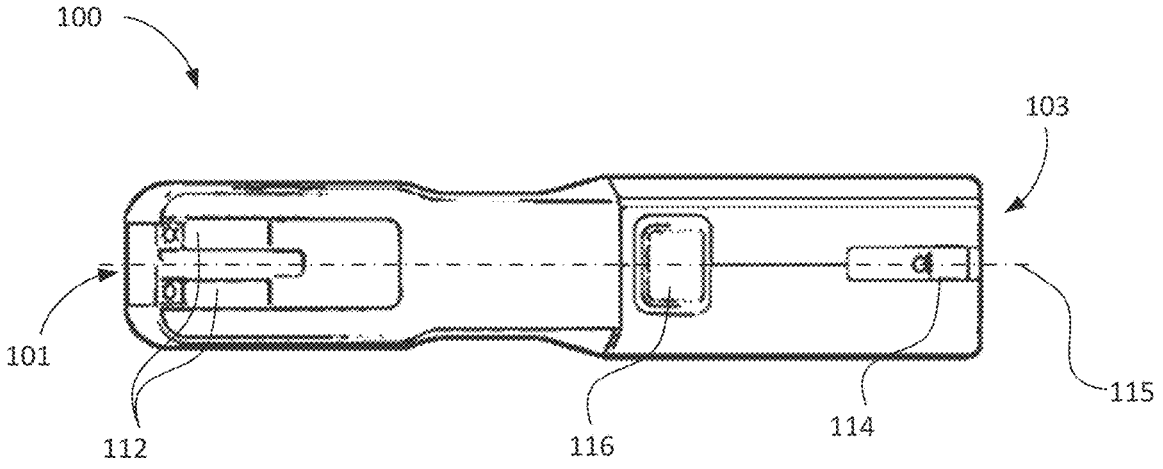
FIG. 2A illustrates a top view of a conducted electrical weapon body according to one or more aspects described herein.
Figure 2B:
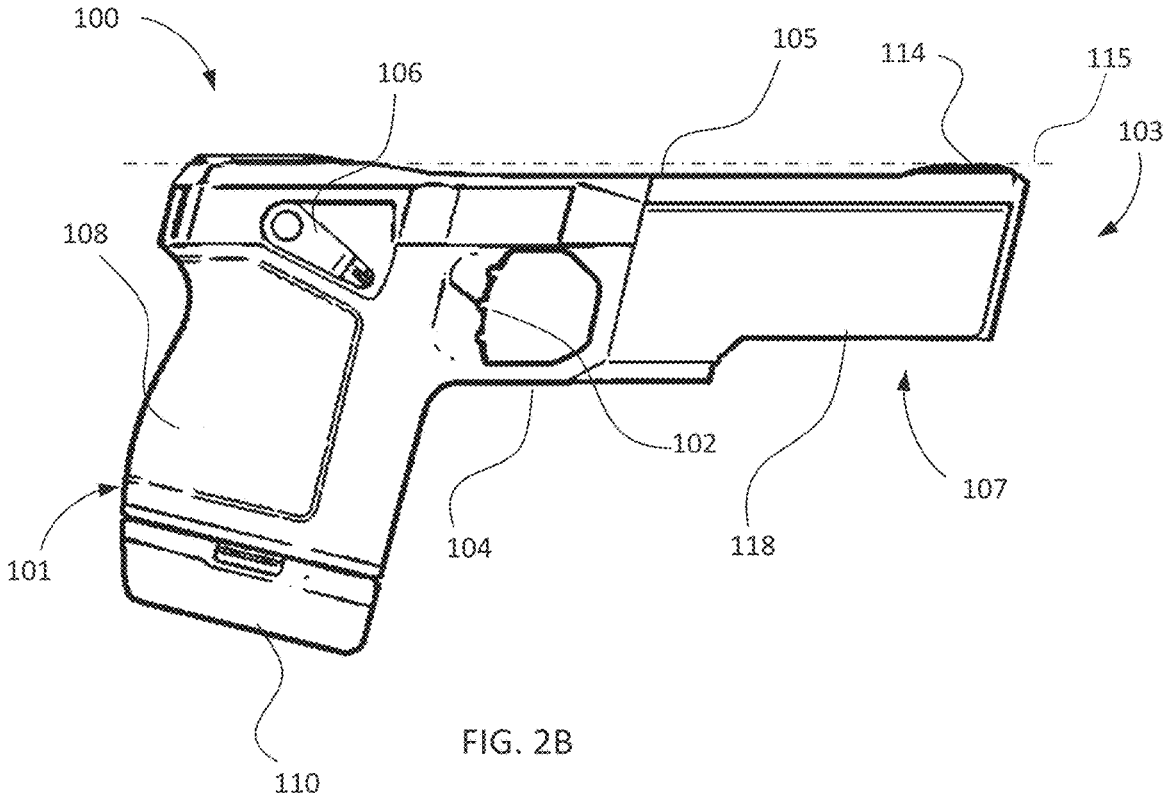
FIG. 2B illustrates a side view of a conducted electrical weapon body illustrated in FIG. 2A according to one or more aspects described herein.

For example, as shown in FIG. 1D, the magazine comprises nine firing tubes 316 grouped together in an array having three rows and three columns (3×3 array). Each firing tube 316 may be oriented parallel with one another with an axis configured to be substantially parallel with an axis 115 defined by sights 112, 114 of the body 100 or corresponding with the laser spot indicators or LED illuminators as shown in FIG. 1D. In various embodiments, a distance between the longitudinal axes of parallel firing tubes 316 may be less than 0.5 inches (1.27 centimeters), less than 0.25 inches (0.64 centimeters, less than 0.13 inches (0.03 centimeters), or less than 0.06 inches (0.15 centimeters), in accordance with various embodiments discussed herein. In other embodiments, as described in more detail below, the magazine 300 may have a plurality of firing tubes 316 arranged where the firing tubes in a top row are arranged in an orientation substantially parallel to the axis defined by sights 112, 114 of the body 100 (e.g., axis 115), and the firing tubes 316 below the top row of firing tubes 316 may be oriented either substantially parallel to the firing tubes 316 of the top row, or oriented at an axis forming an acute angle with an axis of a firing tubes 316 arranged in the top row. In various embodiments, a maximum distance between the longitudinal axes of oblique firing tubes 316 may be less than 0.5 inches (1.27 centimeters), less than 0.25 inches (0.64 centimeters, less than 0.13 inches (0.03 centimeters), or less than 0.06 inches (0.15 centimeters), in accordance with various embodiments discussed herein. When electrodes 212 launch from firing tubes 316 oriented with an angle to each other, the trajectory of the electrodes launch in different directions such that the flight paths diverge from one another with approximately the same angle between them. For a particular angle between firing tubes 316, the distance to the target may determine the spread between the electrodes 212 when they reach the target.

In various embodiments, magazine 300 may comprise at least three firing tubes arranged in a single column. For example, each inner surface of the at least three firing tubes may be tangent with a same plane. A longitudinal axis of each of the at least three firing tubes may be coplanar. The longitudinal axis of each of the at least three firing tubes may intersect a common plane. The at least three firing tubes may each be oriented at one or more angles with a first firing tube. A first pair of firing tubes may be oriented at a first angle with one another may be configured to launch electrodes 212 at a first trajectory to provide an optimal and/or minimum spacing at a first distance to a target. A second pair of firing tubes oriented at a second angle with one another may be configured to launch electrodes 212 at a second trajectory to provide the optimal and/or minimum spacing at a second distance to the target. The first pair of firing tubes may share a common firing tube with the second pair of firing tubes. Magazine 300 may be configured to selectively launch electrodes 212 from a first pair of firing tubes to achieve the optimal spread at a first range, to selectively launch electrodes 212 from a second pair of firing tubes to achieve the optimal spread at a second range, to selectively launch electrodes 212 from a third pair of firing tubes to achieve the optimal spread at a third range, and so on. As another example, magazine 300 may be configured to launch electrodes from each of the plurality of firing tubes to achieve the optimal spread at a plurality of ranges. Magazine 300 may be configured to provide the optimal spread at a number of ranges equal to the number of distinct angles formed by each of the plurality of firing tubes with a first firing tube of the plurality of firing tubes. In this manner, magazine 300 may be configured to provide the optimal spread of electrodes 212 at multiple ranges. Magazine 300 may be configured to selectively launch two or more electrodes 212 in accordance with positional and/or environmental data as discussed further herein. In various embodiments, magazine 300 may be configured to launch less than all of the plurality of firing tubes 316.

For example, magazine 300 may comprise a first firing tube 316*a*, a second firing tube 316*b*, and a third firing tube 316*c*. First firing tube 316*a*, second firing tube 316*b*, and third firing tube 316*c* may be arranged in a single column. First firing tube 316*a* may be configured to be oriented parallel to axis 115 of body 100 when magazine 300 is engaged with body 100; second firing tube 316*b* may form a first acute angle with the first tube 316*a*; and third firing tube 316*c* may form a second acute angle with the first firing tube 316*a*. In various embodiments, the first acute angle may be less than the second acute angle. Magazine 300 may be configured to selectively launch electrodes 212 from at least two of the at least three firing tubes. For example, magazine 300 may be configured to launch electrodes 212 from first firing tube 316*a* and second firing tube 316*b* to provide the optimal spread at a first distance. Magazine 300 may be configured to launch electrodes 212 from first firing tube 316*a* and third firing tube 316*c* to provide the optimal spread at a second distance. As another example, magazine 300 may be configured to launch electrodes 212 from each of firing tubes 316*a*, 316*b*, and 316*c* to achieve the optimal spread at the first distance and the second distance.

In embodiments, a column of the plurality of firing tubes 316 may be disposed linearly in a direction between the top surface 302 and the bottom surface 304 of magazine 300. A longitudinal axis of each firing tube in the column may intersect a line along front surface 306 of magazine 300. A longitudinal axis of each firing tube in the column may be disposed in a same plane. The plane may bisect magazine 300. The column may include at least three firing tubes of the plurality of firing tubes. For example, a column of firing tubes of the plurality of firing tubes 316 may be disposed along an axis along which the cross-section of FIG. 1D is defined, as illustrated in FIG. 1C. In embodiments, the column may include four firing tubes of the plurality of firing tubes. In embodiments, the column may be disposed substantially perpendicular to one or more of top surface 302 and bottom surface 304.

In various embodiments, magazine 300 may include a plurality of columns. The plurality of columns may be disposed parallel to each other. Longitudinal axes of a first set of firing tubes in a first column may be parallel to longitudinal axes of a second set of firing tubes in a second column of the plurality of columns. Each column of the plurality of columns may include a same number of firing tubes. In embodiments, the plurality of columns may include two or more columns, three or more columns, or four or more columns. The plurality of columns may be configured to launch sets of electrodes from the plurality of firing tubes from similar positions on the magazine 300. For example, a position of a first firing tube in a first column may be horizontal to a position of a second firing tube in a second column of the plurality of columns.

While the exemplary magazine 300 illustrated in FIGS. 1B-1E shows nine firing tubes 316, the number of firing tubes may have any number, such as 12 or 18 firing tubes as described below. In addition, the magazine 300 and unitary cartridge 200 arrangement may provide a user with the ability to carry a number of cartridges in a compact arrangement. This arrangement may be expressed as a ratio of cartridges to volume. For example, in some embodiments, the unitary cartridge 200 may have a volume of less than 0.4 cubic inches (6.6 cubic centimeters) allowing the magazine 300 to store three cartridges in approximately 1.2 cubic inches. In other examples, the magazine may store three cartridges within a volume of 1.2 cubic inches (19.7 cubic centimeters) to 2.0 cubic inches (32.8 cubic centimeters).

Diverging trajectories may result in electrodes that strike a target at a distance from each other. Preferably, at least two electrodes are positioned at least 6 inches (15.2 centimeters) away from each other while coupled to the target to increase an amount of target tissue through which the stimulus signal travels. For example, for an angle of 8 degrees between the firing tubes may achieve a separation of 7 inches (17.8 centimeters) at a distance of 4.14 feet (1.26 meters) from the target. In some instances, the electrodes 212 may be launched along diverging trajectories by firing them from firing tubes 316 arranged at diverging angles. In other instances, when firing them from firing tubes 316 that are parallel to each other, a user may create the desired spacing of electrodes 212 on the target by serially activating (e.g., serial firing, serial launch) the unitary cartridges 200 while moving the CEW 10 between activations to set the diverging trajectories. For example, a user may aim the CEW 10 at a first location on a target and launches a first electrode 212. Then the user may then reposition the CEW 10, aim the CEW 10 at a second location on the target and launch a second electrode 212. The user may aim, and fire until all cartridges 200 in the magazine 300 have launched their respective electrodes 212 toward different locations on the target. In this manner, the user may determine the spread of the electrodes 212 and the number of electrodes launched toward the target. Any delay between firing the electrodes 212 from any two cartridges may be determined by the user.

Figure 3A:
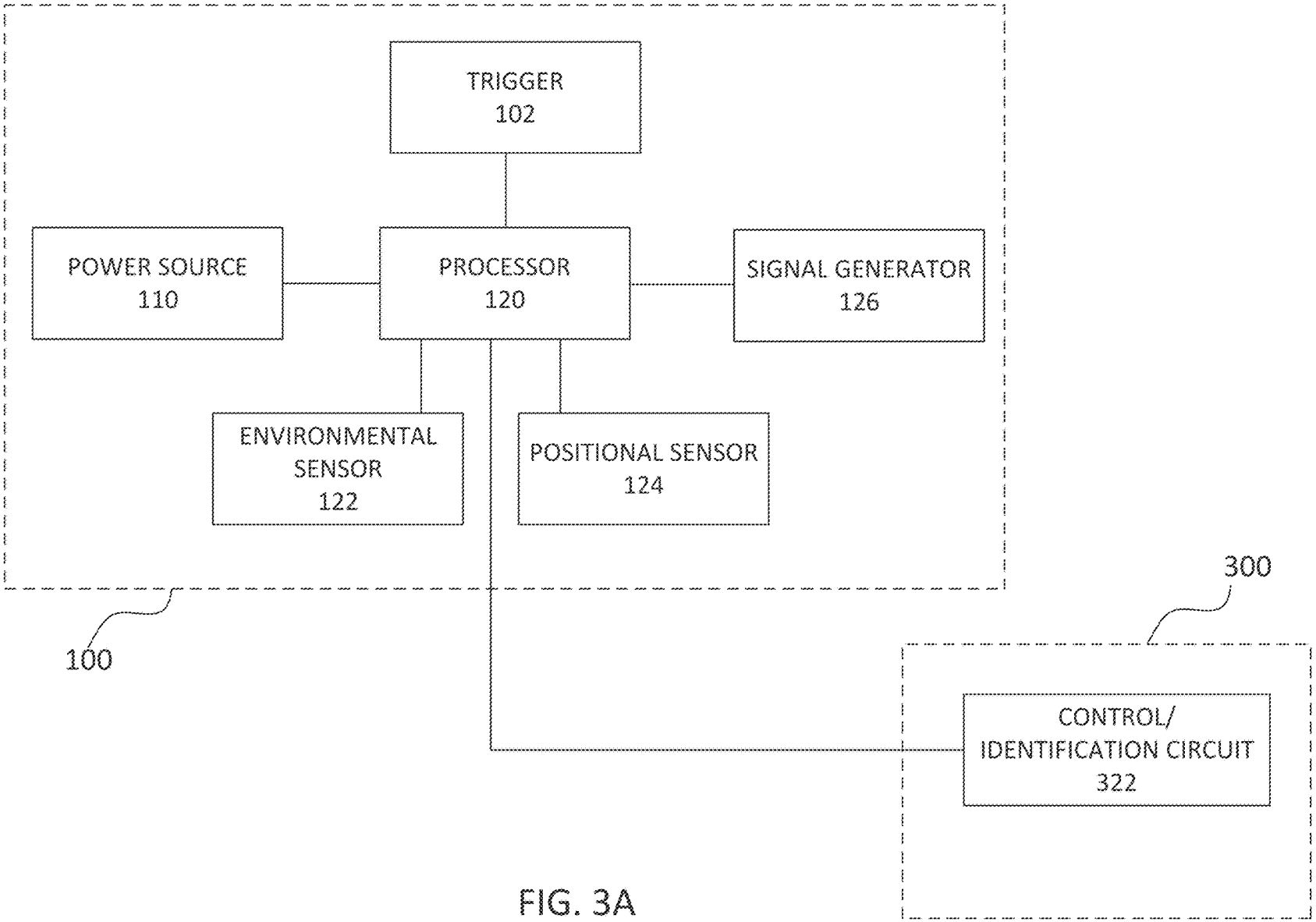
FIG. 3A illustrates a schematic of the conducted electrical weapon according to one or more aspects described herein.
Figure 3B:
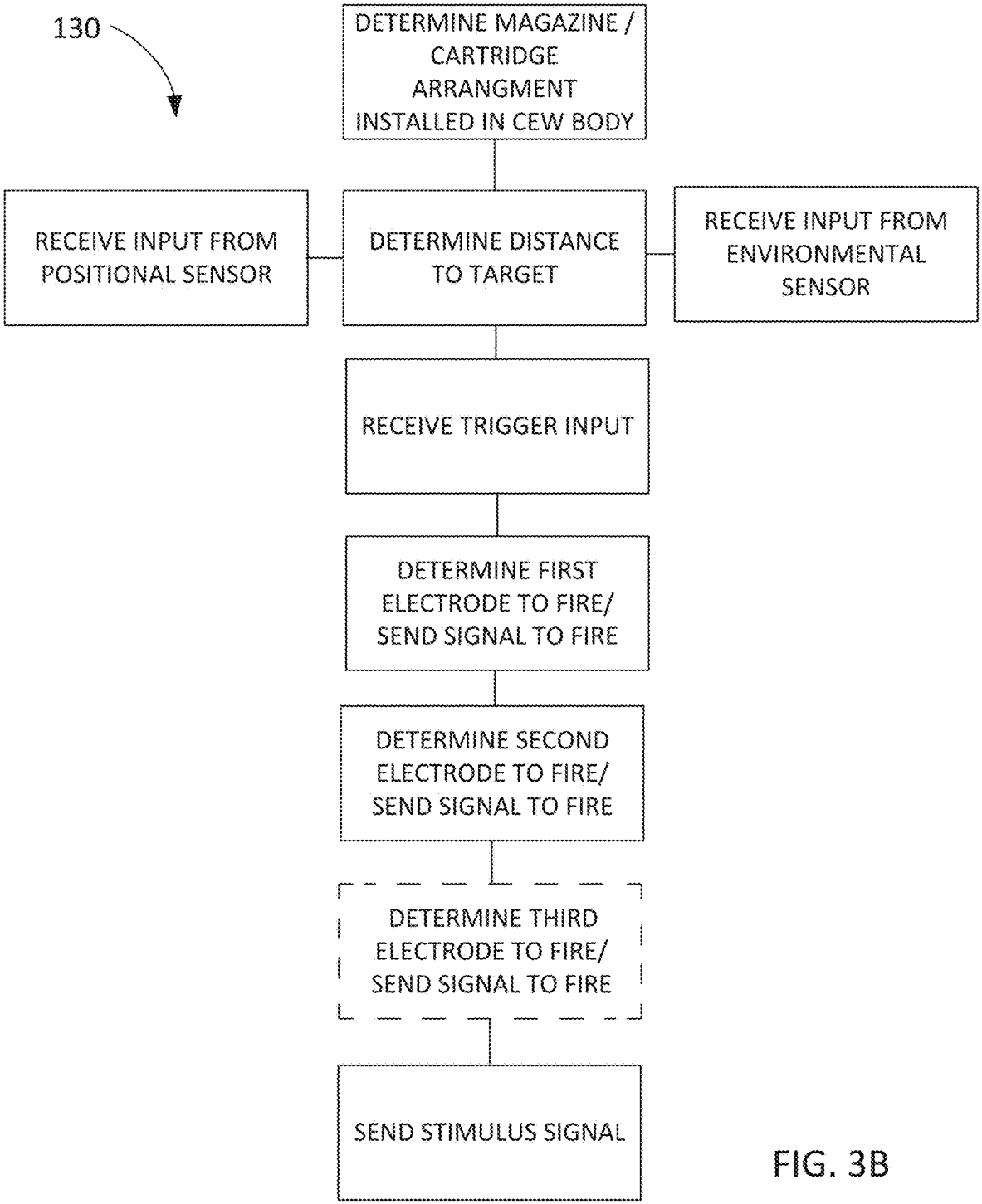
FIG. 3B illustrates a flowchart of an exemplary fire control process of the conducted electrical weapon.

As illustrated in the schematic of FIG. 3A, the body 100 may further comprise a processor or processing circuit 120 and/or sensors configured to control the operation of the weapon. The processor 120 may connect to power source 110 to control the power distribution to the sensors 122, 124 as well as the signal generator 126. The CEW 10 may be configured to selectively launch an electrode 212 or plurality of electrodes 212 in the firing tubes 316 of the magazine 300 based on data received from either environmental sensors 122 or positional sensors 124, or a combination of the data provided from the environmental or positional sensors 122, 124 provided on the body 100 of the CEW 10. Sensors 122, 124 may be passive or active and may include positional sensors 124, such as accelerometers, magnetometers, or gyroscopes as well as environmental sensors 122 such as a photosensitive sensor, and barometers. These photosensitive sensors may include a laser range sensor, infrared sensor, motion detector, or similar detector. In addition, the magazine 300 may include a control/identification circuit 322 to communicate with the processor 120, where the processor 120 may determine which magazine 300 is installed into the body 100 and configure the CEW 10 accordingly. For example, the data provided by the control circuit 322 may include the number of cartridges 200, characteristics of the cartridges 200 (e.g. distance range (wire tether length), amount of propellant/exit velocity of the electrode, voltage requirements for the electrode), the orientation of the firing tubes 316 in the magazine 300, and the status of the firing tubes (e.g. which tubes contain cartridges 200 and which tubes are empty or have been fired). In addition, the control circuit 322 may communicate the type of cartridge installed, such as live cartridges, training cartridges, or inert/resettable cartridges. This control circuit 322 may also receive and transmit the firing and stimulus signals from the CEW 10 to the unitary cartridges 200. In some embodiments, the CEW 10 may be configured to utilize a processor 120 and sensors 122, 124 to determine the distance of a target from a user. In some cases, the processor 120 may be receiving data from the various environmental and positional data from sensors 122, 124 along with the data gathered from the magazine 300, such that when an input to fire is received from the trigger 102, the processor 120 can use this data to determine the appropriate electrodes 212 to fire at the target to provide the most effective stimulus on the target as shown in the fire control process 130 shown FIG. 3B. Upon determining the proper fire control process 130, the processor 120 may then selectively arm a plurality of unitary cartridges 200 in the plurality of firing tubes 316 to launch a plurality of electrodes 212 at a plurality of angles toward a target. For example, in response to receiving an input of trigger 102, processor 120 may selectively arm and launch electrodes 212 from a first pair of firing tubes 316 in accordance with environmental and positional data from sensors 122, and 124. As another example, in response to receiving an input of trigger 102, processor 120 may selectively arm and launch electrodes 212 from a three firing tubes 316 of the plurality of firing tubes 316, where each of the three firing tubes 316 are oriented at a different trajectory with respect to one another. In various embodiments, magazine 300 may be configured to launch electrodes 212 from less than all of the plurality of firing tubes 316 in response to an activation of the trigger 102. In some embodiments, magazine 300 may be configured to launch electrodes 212 from all of the plurality of firing tubes 316 in response to an activation of the trigger 102. The plurality of electrodes 212 may be fired serially or simultaneously. The process for detecting the distance between a CEW 10 and a target is described in U.S. patent application Ser. No. 16/025,300 filed on Jul. 2, 2018, which is incorporated by reference in its entirety. Optionally, the magazine 300 may also include environmental or positional sensors to send data to the processor 120 of the body 100 to further assist in the fire control process 130.

The electronics of the body 100 may control the operation of the CEW 10. The processor or processing circuit 120 may comprise a microprocessor or microcontroller and memory storage. The electronics within body 100 may further include a communications circuit. A processor 120 may control some or all of the operations (e.g., functions) of a CEW 10 including power management. The processor 120 may control the launch of electrodes 212 as well as control the signal generator 126, completely or in part, to provide one or more stimulus signals. The processing circuit 120 may receive signals from sensors 122 to determine whether another stimulus signal should be provided to a target.

A signal generator 126 may generate a stimulus signal. The signal generator 126 may receive energy from power source 110, and may transform the energy from power source 110 to form the stimulus signal. For example, the signal generator 126 may increase the voltage of the electrical power provided by power source 110 up to approximately 100 volts or in some cases approximately 1,600 volts. Accordingly, in some embodiments, the signal generator 126 may provide pulses of current at a voltage of about 100 volts, while in other embodiments, the signal generator 126 may provide pulses of current at a voltage of about 1,500 volts. The signal generator 126 may provide a series of pulses of current as a stimulus signal, where the pulse of current may have a pulse width. A series of pulses of current may have a pulse repetition rate. The stimulus signal may include a fixed number of current pulses provide over a predetermined period of time, or in some embodiments, the stimulus signal may include a variable number of current pulses over a predetermined period of time.

The signal generator 126, as discussed above, may couple (e.g., directly, indirectly) to two or more wire tethers. The signal generator 126 may electrically couple to a wire tether via one or more spark gaps, a transformer, and/or a silicon control rectifier (e.g., thyristor). The two or more wire tethers may couple to respective electrodes. A signal generator 126 may provide a stimulus signal through target tissue via two or more electrodes and their respective wire tethers.

The power source 110 may include any type of power source that provides energy for operating the CEW 10 and for immobilization of the target. For example, a power source 110 may comprise a one or more rechargeable or disposable batteries. The power source 110 may be releasably engaged or may be permanently installed. The battery (or batteries) may be rechargeable such that they can be reenergized when either removed or installed in the body 100. The power source 110 may also provide energy for operation of the electronics and signal generator of the CEW 10.

Once one or more of the electrodes 212 have been launched, a user may remove the magazine 300, from the body 100 and insert a new magazine into the magazine bay 118 of the body 100. In some embodiments, the CEW 10 may comprise a kit that includes a body 100 and multiple magazines 300, where each magazine may have the same number of electrodes or a different number of electrodes. After a unitary cartridge 200 has been used (e.g., spent), the unitary cartridge 200 may be removed from the magazine 300, and a new (e.g., used) unitary cartridge 200 may be installed into the empty firing tube 316. In that regard, the magazine 300 may be configured to be reloadable, such that a user may replace a spent unitary cartridge 200 with an unused unitary cartridge 200.

The components of the CEW 10, such as the body 100 and magazine 300 may be formed from metallic materials or a combination of metallic and non-metallic components to provide adequate pathways for the conductive elements. One or more components of CEW 10 may be formed of one or more rigid, durable materials able to withstand force(s) applied to CEW 10 during use. For example, one or more components of CEW 10 may include one or more rigid, plastic materials, metal materials, and/or composite materials. The one or more rigid materials may include corrosion-resistant materials, UV resistant materials, and/or any other suitable material configured to at least partially withstand environmental factors. Rigid materials may include metals and metallic alloys (e.g., aluminum, steel, titanium, etc.), composites (e.g., fiberglass, carbon fiber, etc.), plastics (e.g., polycarbonate, acrylonitrile butadiene styrene, polyether ether ketone, etc.), and/or the like. The rigid materials may also be treated (e.g., heat-treated, galvanized, anodized, etc.), painted (e.g., powder-coated, e-coated, etc.), and/or similarly modified to aid in withstanding environmental factors. The body 100 and magazine 300 may be formed using any number of methods, such as casting, forging, molding, and machining. In addition, body 100 and magazine 300 may be formed of multiple components that are assembled together.

Figure 4A:
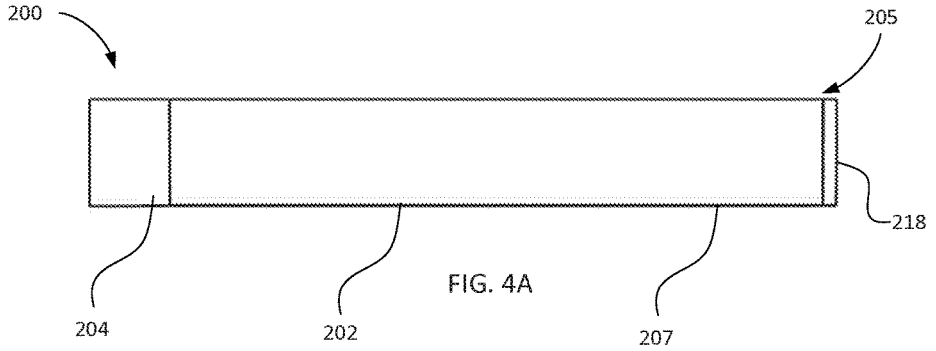
FIG. 4A illustrates a side view of a unitary cartridge for use in a conducted electrical weapon according to one or more aspects described herein.
Figure 4B:
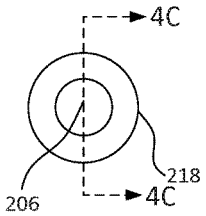
FIG. 4B illustrates an end view of the unitary cartridge illustrated in FIG. 3A according to one or more aspects described herein.
Figure 4C:
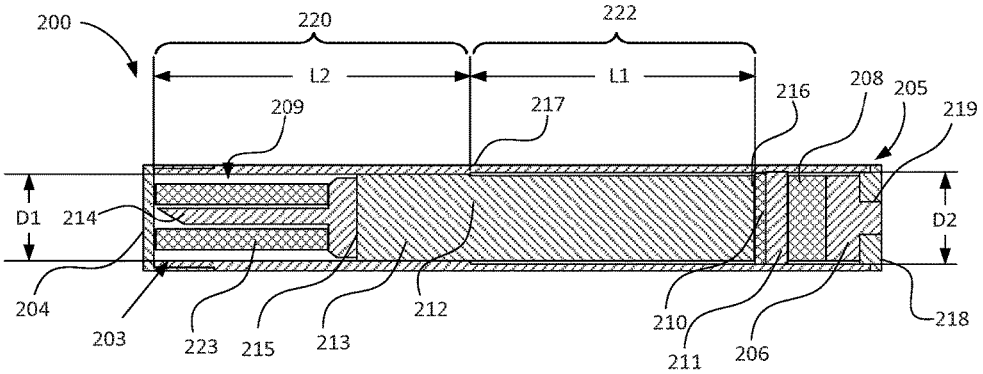
FIG. 4C illustrates a cross-sectional side view of the unitary cartridge illustrated in FIG. 4B according to one or more aspects described herein.

FIGS. 4A-4C depict views of the unitary cartridge 200 that can be loaded into the magazine 300. Unitary cartridge 200 may have a cartridge body 202 having a first end 203, a second end 205 opposite the first end 203, a cylindrical outer surface 207 extending between the first end 203 and the second end 205, and a hollow inner portion 209. A frangible end cap, or lid, 204 may be attached to the first end 203 of the cartridge body 202. An electrode 212 may be positioned in the hollow inner portion 209, where the electrode, or probe, 212 may include an electrode body 213 and a spear 214. The electrode body 213 may include a first end 215 and a second end 216 opposite the first end 215, wherein the spear 214 extends from the first end 215 of the electrode body 213. A piston, or piston driver, 210 may be positioned adjacent the second end 216 of the electrode body 213, where the piston may act as a plunging mechanism to force the electrode 212 from the cartridge body 202. A wad 211 may be positioned adjacent the piston 210 such that the wad 211 is positioned between the piston 210 and the propulsion module, or primer, 208. The propulsion module 208 may be configured to receive an electrical signal via a propulsion module contact, or primer contact, 206 positioned adjacent the propulsion module 208. The propulsion module contact 206 may be configured to transmit an electrical signal from a body 100 to the propulsion module 208 to fire electrode 212 from the cartridge body 202. A cap 218 may be arranged at the second end 205 of the cartridge body 202, where the cap 218 seals against the cartridge body 202. The cap 218 may have a central opening 219 such that the propulsion module contact 206 extends at least a portion through the opening 219 and the opening 219 surrounds a portion of the propulsion module contact 206.

Upon receiving an electrical signal from the body 100, the primer 208 may discharge, resulting in a rapid increase of gas. The resulting rapid increase in gas may then act on the piston driver 210, propelling the piston driver 210 along a length of the cartridge body 202 and propelling the electrode 212 out of the cartridge body 202. The piston 210 may travel along the inside of the cartridge body 202, until the piston 210 contacts a mechanical feature configured to stop the piston 210 at a predetermined distance or length, L1, such as piston stop 217.

Spear 214 may aid in mechanical and electrical coupling of an electrode to a target. The spear 214 may include a pointed (e.g., narrowed, sharpened) end portion to aid in piercing or penetrating target clothing and/or target tissue. A spear 214 may be wholly or partially electrically conductive to establish an electrical connection with a target. A spear may include one or more mechanical structures (e.g., barbs) for retaining mechanical and electrical coupling of the spear 214 to the target. For example, in some instances, spear 214 may include two barbs.

Electrode 212 may further include a wire tether (e.g., filament, wire) (not shown) stowed (e.g., stored) inside electrode body 213. A first end portion of the wire tether may electrically couple to body 213 and/or spear 214. The component (e.g., body, spear) to which the first end portion of the wire tether couples is electrically conductive. A second end portion of the wire tether may electrically couple to one of cartridge body 202 and piston 210. Piston 210 may be formed of an electrically conductive material.

Front-end cap 204 may cover an open first end 203 of a cartridge body 202. End cap 204 protects the electrode 212 positioned in cartridge body 202 prior to use of the unitary cartridge 200. Cap 204 may removably couple to cartridge body 202 and may be removed from the cartridge body 202 by activation of the unitary cartridge. Upon launch of the electrode 212, the spear 214 of the single electrode 212 may push against the cap 204 causing the cap 204 to be removed or break upon impact. Thus, the cap 204 may move away from the trajectory of the electrode 212 to not interfere with flight of the electrode 212 to its target. For example, cap 204 may mechanically couple to body 202 and in some embodiments form a hermetic seal against the body 202.

In embodiments, cap 204 may cover an opening of cartridge body 202 at first end 203, was well as one or more outer surfaces of cartridge body 202. The one or more outer surfaces may include one or more outer surfaces defining a circumference of cartridge body 202 at first end 203, such that cap 204 encloses a portion of cartridge body 202 at first end 203. The circumference may be a full circumference, such that cap 204 fully encloses a portion of cartridge body 202 at first end 203. Cap 204 may surround a portion of first end 203 of cartridge body 202, attached across the opening of cartridge body 202 and at least two opposite outer surfaces of the one or more outer surfaces of cartridge body 202.

Cap 204 may extend a length L3 along cartridge body 202, parallel to a direction in which electrode 212 may be launched from cartridge body 202. In embodiments, length L3 may be equal or greater than a diameter of cap 204 across the opening of cartridge body 202. In embodiments, length L3 may be equal or greater than half the diameter of cap 204 across the opening of cartridge body 202. Length L3 may be greater than a thickness of cap 204 along distance L2. In embodiments, length L3 may be greater than a distance between spear 214 and cap 204 prior to launch of electrode 212. A perpendicular cross-section of unitary cartridge 200 along length L3 may include spear 214, a first portion of cap 204 on a first outer surface of cartridge body 202, and a second portion of cap 204 on a second outer surface of cartridge body 202, opposite the first outer surface. Length L3 may be selected to ensure retention of cap 204 on first end 203 and/or improve resistance of cap 204 to incidental forces that may be applied to cartridge body 202 from different directions, including incidental forced that may be encountered prior to the unitary cartridge 200 being inserted into a magazine. Upon placement of unitary cartridge 200 into the magazine, a portion of cap 204 at first end 203 may be physically retained (e.g., pressed) between the one or more outer surfaces of cartridge body 202 and the magazine, improving retention of cap 204 on cartridge body 202 prior to launch of electrode 212 from cartridge body 202.

Rear cap 218 covers at least a portion of the second end 205 of cartridge body 202. A cap 218 may couple to cartridge body 202. The cap 218 may provide access to a primer contact 206, where the primer contact 206 may provide a path for an electrical current. The cap 218 may be formed of a material that insulates, such that the cap 218 may resist or deny formation of a path for a current of electricity. This material may include electrical insulators. Cap 218 may remain coupled to a cartridge body 202 before, during and after activation of the unitary cartridge 200. Cap 218 may seal against the cartridge body 202 to resist or prevent an escape of gas when the pyrotechnic material of the propulsion module 208 is ignited. As shown in the exemplary embodiment, cap 218 attaches and seals to the cartridge body 202. The cap 218 has an opening 219 that surrounds and seals around a portion of the primer contact 206. An end of the contact 206 is left exposed at the rear of the unitary cartridge 200 so that a current may flow through the contact 206 to the primer 208 to fire the electrode 212 at the target.

Because cap 218 seals against the cartridge body 202 and a portion of contact 206, cap 218 functions as a barrier against the passage of the expanding gas generated upon the ignition of primer 208. This seal created by the cap 218 may help to retain the rapidly expanding gas inside the cartridge body 202 and to focus the gas on moving the piston 210 to propel the electrode 212 to the target. Cap 218 may act to reduce or prohibit the passage of the gas produced by primer 208 rearward indefinitely or for a period of time after igniting primer 208 to allow the electrode 212 to exit the cartridge body 202.

As discussed above, the cartridge body 202 may have a first end 203, a second end 205 opposite the first or forward end 203, a cylindrical outer surface 207 extending between the forward end 203 and the second end 205, and a hollow inner portion 209. In some embodiments, the cylindrical outer surface 207 may have a diameter of approximately 8 millimeters (mm), or within a range of 7 mm and 9 mm.

Cartridge body 202 may be configured to house and store a single electrode 212, a piston 210, a wad 211, a primer 208, and a contact 206 prior to the launch of the electrode 212. The body 202 may couple to a cap 204 and a cap 218. A hollow inner portion 209 may be generally cylindrical in shape and may receive and store the single electrode 212 prior to launch. The electrode body 213 may be generally cylindrical in shape such that the electrode 212 and the hollow inner portion 209 are substantially coaxial. In this manner, the hollow inner portion 209 may help to set the initial trajectory of the electrode 212.

In embodiments, cartridge body 202 may have an outer surface that is symmetrical about a central axis of unitary cartridge 200. The central axis may be an axis along which electrode 212 travels upon being launched from unitary cartridge 200. The symmetrical outer surface may include a cylindrical outer surface. In embodiments, the cylindrical outer surface may be devoid of grooves, shoulders, or other irregular contours between first end 203 and second end 205. That is, the cylindrical outer surface may be flat between first end 203 and second end 205. In other embodiments, a cylindrical outer surface may comprise grooves, shoulders, or other irregular contours between first end 203 and second 205 configured to engage one or more respective surfaces of a magazine to retain cartridge body 202 in the magazine. The symmetrical outer surface may include one or more outer surfaces positioned regularly about the central axis. In embodiments, a cross-section of the symmetrical outer surface, perpendicular to the central axis, may have a shape of one of a circle, ellipse, triangle, square, rectangle, hexagon, or another regular polygon. Because unitary cartridge 200 is configured to launch a single electrode 212, the cartridge body 202 may have a symmetrical outer surface because the orientation of the electrode 212 relative to another electrode is not determined by a common cartridge body in which both electrodes are housed; rather, the relative position is determined by a separate magazine (e.g., magazine 300) as discussed elsewhere herein. Accordingly, a symmetrical outer shape may increase a number of rotational orientations at which cartridge body 202 may be inserted into a magazine, thereby decreasing a maximum degree to which cartridge body 202 may need to be rotated before being inserted into a magazine and thus simplifying a loading process for cartridge body 202 into the magazine. In embodiments, the symmetrical outer surface may include one or more linear outer surfaces between first end 203 and second end 205. Each linear outer surface of the one or more linear outer surfaces may be devoid of grooves, shoulders, or other irregular contours between first end 203 and second end 205. That is, each linear outer surface may be flat between first end 203 and second end 205. In other embodiments, one or more linear outer surfaces may comprise grooves, shoulders, or other irregular contours between first end 203 and second end 205 configured to engage one or more respective surfaces of a magazine to retain cartridge body 202 in the magazine after loading. The symmetrical outer surface may have a constant, same diameter along the central axis between the first end 203 and the second end 205, thereby simplifying insertion of unitary cartridge 200 into the magazine. In embodiments, cap 204 may have a symmetrical shape as well, corresponding to the symmetrical outer shape of cartridge body 202.

The hollow inner portion 209 may include a first inner portion 220 having a first diameter, D1, and a second inner portion 222 having a second diameter, D2. The piston stop 217 may be positioned a predetermined bore distance or length, L2, from the first end 203. The first diameter, D1, may be smaller than the second diameter, D2. The piston stop 217 may be a shelf that is formed along the perimeter where the first inner portion 220 connects to the second inner portion 222. The piston stop 217 may extend around the full circumference of the interior of the cartridge body 202, or may extend along only a portion of the circumference of the interior of the cartridge body 202. In some embodiments, the distance, L2, between piston stop 217 and first end 203 of the cartridge body 202 may be configured to alter the kinetic energy imparted on electrode 212 and spear 214. The diameters D1, D2 may be greater than the outside diameter of the electrode body 213. In embodiments, a piston travel distance or length, L1, may include a distance between piston stop 217 and piston 210 prior to launch of electrode 212 from unitary cartridge 200. Piston travel distance, L1, may include a maximum range of travel for piston 210. In embodiments, first inner portion 220 may be disposed in cartridge body 202 along bore distance L2 and/or second inner portion 222 may be disposed in cartridge body 202 along piston travel distance L1.

The propulsion module 208 may comprise any type of device that may be controlled to provide a rapidly expanding gas. The propulsion module 208 may be ignited to launch the single electrode 212 from the unitary cartridge 200. The primer 208 may be ignited in any manner, such as by a striking (e.g., percussion) movement that directly or indirectly contacts the primer or electrically by passing a current through the primer 208. When electrically ignited, the electrical current by a direct current or an alternating current. In some embodiments, the electrical current for igniting a primer may be a pulsed current or a current provided as a step function. The polarity of the current may be positive or negative.

For example in some embodiments, primer 208 may be ignited via a mechanical striking force. For example, a mechanical striking force may be applied to contact 206. The striking force may be transferred by contact 206 to primer 208. The striking force may pierce (e.g., penetrate) and/or crush (e.g., compress) primer 208 thereby causing (e.g., initiating) a chemical reaction in primer 208 that causes the pyrotechnic material of primer 208 to burn (e.g., ignite). The burning of primer 208 produces a rapidly expanding gas. The striking force may be provided by any object such as a firing pin.

In other embodiments, primer 208 may be ignited via an electrical current. For example, a current may be provided to contact 206. Contact 206 may include electrical paths (e.g., conductors) that permit the current to flow through contact 206 to primer 208. Contact 206 may include mechanical structures that include electrical paths to the primer 208. Flow of a current to the primer 208 may cause a conductor to heat up thereby igniting the pyrotechnic material inside primer 208. An electrical path for the current may include contact 206, primer 208, and cartridge body 202. For example, body 202 of unitary cartridge 200 may be grounded and a voltage having a positive or negative polarity may be applied to contact 206 to induce a current to flow through contact 206 to primer 208. Igniting the pyrotechnic material in primer 208 produces a rapidly expanding gas.

Because cap 218 remains coupled to body 202 during launch of electrode 212, the force from the rapidly expanding gas directed against contact 206 is redirected forward against wad 211. The wad 211 applies a force on a piston 210, and the piston 210 applies a force on a rear-end portion of the single electrode 212. The force from the rapidly expanding gas moves the wad 211, the piston 210, and the electrode 212 in a forward direction. As the single electrode 212 moves in a forward direction, the spear 214 of the electrode 212 applies a force on the cap 204 of the unitary cartridge 200, which moves the cap 204 away from the cartridge body 202. Removing the cap 204 from the body 202 may permit the electrode 212 to exit the cartridge body 202 to fly toward a target and to provide a stimulus signal through the target.

Figure 4D:
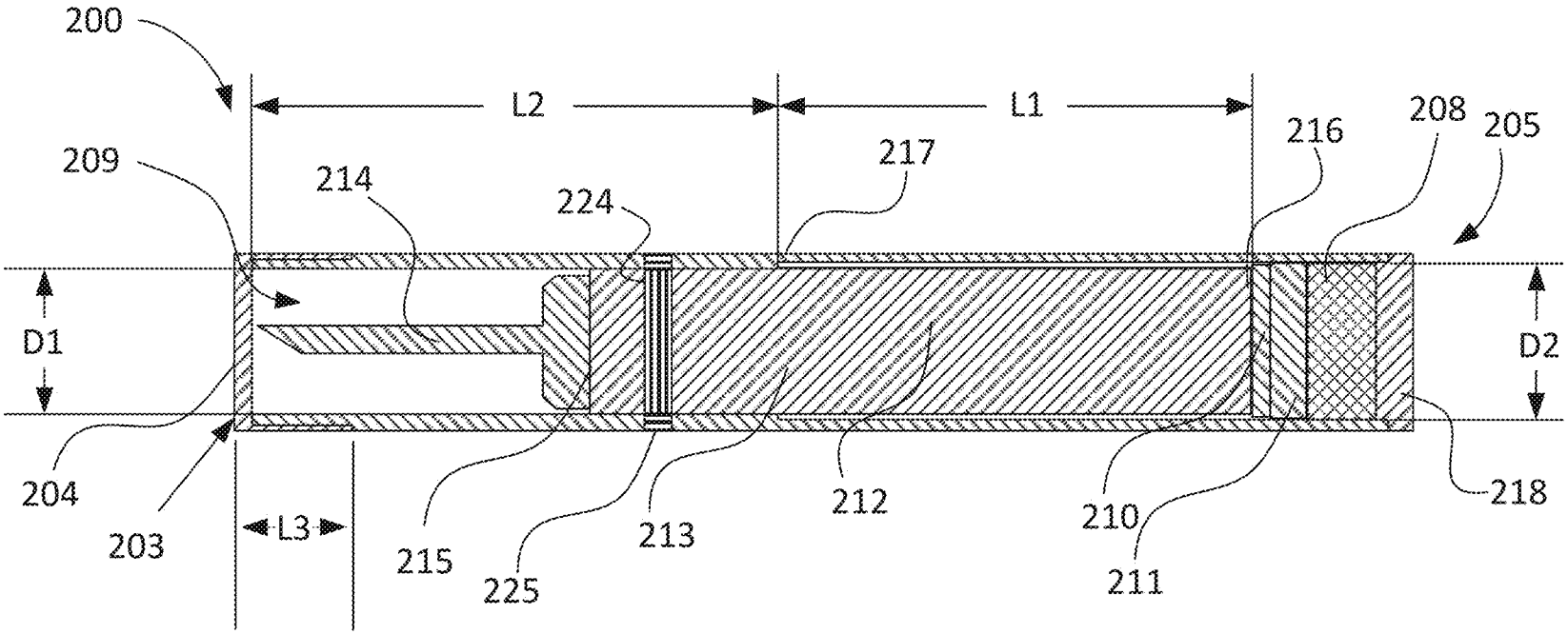
FIG. 4D illustrates a cross-sectional side view of an alternate embodiment of the unitary cartridge illustrated in FIG. 4C according to one or more aspects described herein.
Figure 5A:
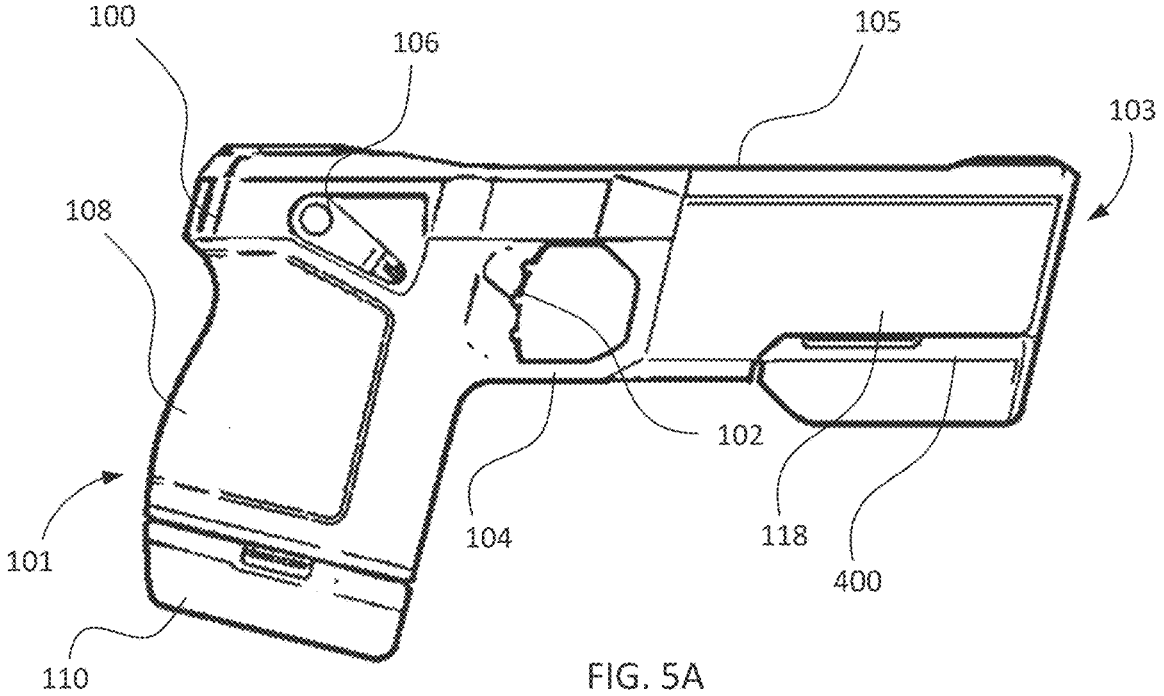
FIG. 5A illustrates a side view of a conducted electrical weapon system with a magazine engaged according to one or more aspects described herein.
Figure 5B:
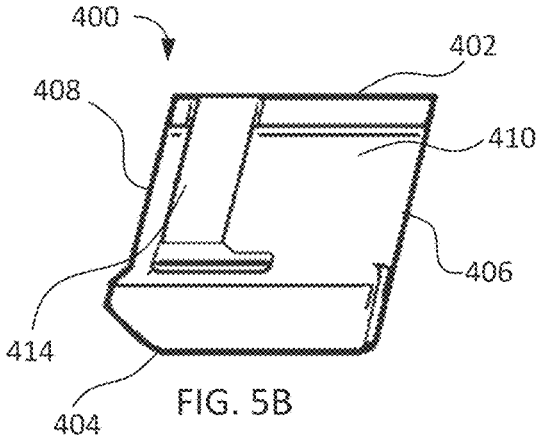
FIG. 5B illustrates a side view of the magazine of the conducted electrical weapon system illustrated in FIG. 5A according to one or more aspects described herein.
Figure 5C:
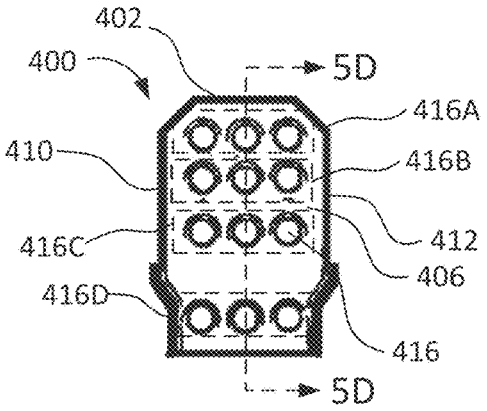
FIG. 5C illustrates a front view of the magazine of FIG. 5B according to one or more aspects described herein.
Figure 5D:
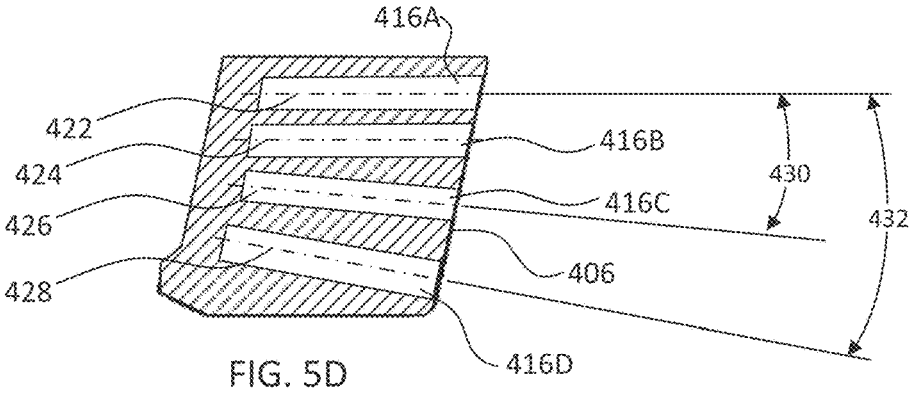
FIG. 5D illustrates a side cross-sectional view of the magazine of FIG. 5B according to one or more aspects described herein.

Alternatively, as shown in the embodiment of FIG. 4D, the unitary cartridge 200 may be configured to have the propulsion module 208 electrically coupled to the cartridge body 202, such that the cartridge body 202 includes electrical paths to the propulsion module 208. For example, cartridge body 202 may be grounded and a voltage having a positive or negative polarity may be applied to cartridge body 202 to induce a current to flow to the propulsion module 208 causing the propulsion module 208 to ignite.

Wad 211, piston 210, and electrode 212 may move in a forward direction until piston 210 contacts (e.g., strikes) piston stop 217. When piston 210 contacts stop 217, piston 210 and wad 211 may cease to move in the forward direction even though the gas provided by primer 208 continues to rapidly expand. In other words, when piston 210 contacts stop 217, piston 210 and wad 211 may cease to move forward even though the force applied on wad 211 and piston 210 may increase for a period of time after piston 210 contacts stop 217.

In embodiments, piston 210 may contact stop 217 directly. A surface of the stop 217 may physically strike a surface of the piston 210. Travel of piston 210 along distance L1 may be physically unimpeded by another material or element of unitary cartridge 200. In such an arrangement, gas provided by primer 208 may be sealed within hollow inner portion 209 by one or more elements (e.g., wad 211) other than piston 210, eliminating a need for the gases to be retained within hollow inner portion 209 by piston 210 itself or another element otherwise positioned on a side of piston 210 adjacent electrode 212. By enabling piston 210 to contact stop 217 directly, a number of potentially interfering of elements may be reduced or eliminated and consistency of travel of piston 210 along piston travel distance L1 may be improved.

Forward movement of electrode 212 does not cease when piston 210 contacts piston stop 217. Because electrode 212 is not mechanically coupled to piston 210, even though the forward movement of piston 210 stops upon contact with stop 217, electrode 212 continues to move in a forward direction until the entirety of electrode 212 exits hollow inner portion 209 of cartridge body 202. The interior walls of body 202 that define hollow inner portion 209 set (e.g., determine) the direction of travel (e.g., trajectory) of electrode 212. As electrode 212 exits body 202, electrode 212 travels (e.g., flies), at least initially, along a trajectory that is coincident with a central axis of hollow inner portion 209.

Wad 211 may contact the inner walls of hollow inner portion 209. The wad 211 establishes a seal around the inner walls of a cartridge body 202 to reduce an amount of the rapidly expanding gas that bypasses the wad 211 to exit the body 202 with the electrode 212. The wad 211 may retain the rapidly expanding gas so that the gas does not pass, at least initially, forward of the wad 211. By retaining the expanding gas, the force applied to the wad 211, piston 210, and electrode 212 may be increased. Any gas that bypasses the wad 211 may reduce the amount of force that is applied to the electrode 212.

In addition, the wad 211 may reduce the amount of gas that contacts the electrode 212 during launch. Because the rapidly expanding gas is the result of burning a pyrotechnic material, the rapidly expanding gas may contain the byproducts of burning (e.g., soot), which can foul (e.g., dirty) the surface of the electrode 212. Accordingly, by using wad 211, the fouling of the electrode 212 during launch may be reduced.

The wad 211 may be formed of a material (e.g., felt, rubber, plastic) that seals against an inner surface of hollow inner portion 209. In particular, the wad 211 may seal against the second inner portion 222 of the cartridge body 202. During the initial moments after the primer 208 ignites, the seal between wad 211 and the inner surface of second inner portion 222 may reduce or prevent the rapidly expanding gas from passing between the edge of wad 211 and the inner surface of second inner portion 222. Wad 211 may be formed of a material that provides a mechanical structure for transferring a force provide by the rapidly expanding gas to piston 210. The material of wad 211 may be somewhat compressible, but after being compressed the material of wad 211 may be suitably rigid for transferring force from the rapidly expanding gas to piston 210.

After electrode 212 is launched, the gas that was initially contained rearward of wad 211 may slowly leak around wad 211 to escape from cartridge body 202 via the front opening that was covered by cap 204. In addition, excess gases caused may be expelled via vents (not shown) arranged in the cartridge body 202.

The piston 210 may provide a base for pushing against an electrode 212. Piston 210 provides structure for applying a force on to launch the electrode 212. Preferably, the piston 210 may be formed of a stiff (e.g., inflexible, less flexible) material, such as a metallic or rigid polymeric material. The piston 210 may not seal against the surfaces of the second inner portion 222 of the cartridge body 202. The piston 210 may move forward in the body 202 in response to a force applied by the wad 211 on the piston 210. The diameter of a piston 210 may be less than diameter, D2, of the second inner portion 222 rearward of the piston stop 217. The diameter of the piston 210 may be greater than the diameter, D1, of the first inner portion 220 forward of the stop 217. Responsive to the force from the wad 211, the piston 210 may move forward inside the body 202 until the piston 210 contacts (e.g., touches) the stop 217. Forward movement of the piston 210 may stop when the piston 210 contacts the stop 217. Forward movement of the piston 210 pushes electrode 212 forward causing spear 214 to decouple cap 204 from body 202. Because the outer diameter of piston 210 may be greater than the inner diameter, D1, of first inner portion 220 forward of stop 217, piston 210 and wad 211 cannot move forward of stop 217, while the forward movement of electrode 212 continues as it exits body 202 to fly toward a target.

In embodiments, wad 211 may be formed of a different material compared to piston 210. Wad 211 may be formed of a first material, while piston 210 may be formed of a second material, different from the first material. The first material may be more compressible than the second material, enabling wad 211 to form a seal with inner walls of hollow inner portion 209 as noted above. The second material may be more rigid than the first material, enabling the piston 210 to evenly transfer force from rapidly expanding gas of propulsion module 208 to electrode 212. Collectively, the first material and the second material may enable a controlled and efficient transfer of force from the rapidly expanding gas of propulsion module 208 to electrode 212.

In embodiments, wad 211 may be physically separate and separable from piston 210. Prior to being inserted in unitary cartridge 200, wad 211 may be detached from piston 210, enabling wad 211 to be inserted into unitary cartridge 200 prior to piston 210 during assembly of unitary cartridge 200. Wad 211 may be disposed in physical contact with piston 210 in unitary cartridge 200, but wad 211 may not be physically attached to piston 210 via an adhesive or other physically coupling material. By remaining separate, wad 211 may evenly and/or centrally be positioned or self-positioned within hollow inner portion 209 without interference from an adhesive or material coupling the wad to piston 210. A separate wad 211 and piston 210 may also simplify manufacture of wad 211 and piston 201, including when wad 211 and piston 210 comprise different materials as noted above.

In embodiments, a diameter of wad 211 may be equal or greater than a diameter of piston 210. For example, the diameter of wad 211, parallel to a surface of wad 211 immediately adjacent piston 210, may be equal to diameter D2 when wad 211 is positioned within hollow inner portion 209. The diameter of wad 211 may be greater than diameter D2 prior to insertion of wad 211 into hollow inner portion 209, enabling wad 211 to be compressed radially upon insertion into hollow inner portion 209. The larger diameter of wad 211 may ensure that a seal is formed between wad 211 and hollow inner portion 209.

In embodiments, wad 211 may be configured to fully isolate piston 210 from propulsion module 208. Wad 211 may completely occupy (e.g., fill) hollow inner portion 209 between piston 210 and propulsion module 208. Wad 211 may be continuous between inner walls of hollow inner portion 209. An outer edge or periphery of wad 211 may be contiguous with an inner wall or periphery of hollow inner portion 209. A non-zero thickness of wad 211 may be disposed between piston 210 and propulsion module 208 for each location on a surface of piston 210 oriented toward propulsion module 208, parallel to piston travel distance L1. The non-zero thickness may include a same thickness for each location on wad 211 parallel to bore distance piston travel distance L1. Wad 211 may fully cover piston 210 in a direction between piston 210 and propulsion module 208, preventing direct transfer of force from propulsion module 208 to piston 210. By fully covering piston 210, wad 211 may ensure that a rapidly expanding gas from propulsion module 208 does not foul a surface of piston 210, while also increasing evenness and diffusion of the force from propulsion module 208 to piston 210.

In embodiments, a first surface of wad 211 may contact a second surface of piston 210. The first surface may be disposed immediately adjacent the second surface when wad 211 and piston 210 are disposed within unitary cartridge 200. The first surface and/or second surface may be planar, promoting an even transfer of force from propulsion module 208. The first surface and second surface may be complementary in shape, enabling force received on another surface of wad 211, opposite the first surface, to be transferred to piston 210 via a corresponding portion of the first surface and the second surface.

A retention mechanism may retain electrode 212 in unitary cartridge 200 so as to limit movement of electrode 212 relative to cartridge body 202 prior to launch. A retention mechanism, such as a mechanical retention mechanism and/or a magnetic retention mechanism may retain electrode 212 at a predetermined position within cartridge body 202. The retention mechanism may be configured to prevent movement of electrode 212 when unitary cartridge 200 is subjected external forces such as drop, shock, vibration, etc. The retention mechanism may enable electrode 212 to be precisely (e.g., repeatably) positioned in cartridge body 202 during assembly. A retention force provided by the retention mechanism may be less than a force generated by ignition of propulsion module 208. The force from the rapidly expanding gas due to ignition of propulsion module 208 may overcome the retention force provided by retention mechanism for retaining electrode 212 in unitary cartridge 200. In embodiments, a retention mechanism may be provided between first end 203 and piston 210. The retention mechanism may be at least partially disposed in hollow inner portion 209. The retention mechanism may be separate from one or more other elements of unitary cartridge 200, including one or more of cap 204, piston 210, propulsion module 208, and cap 218.

In various embodiments, and with reference to FIG. 4C, a mechanical retention mechanism may retain electrode 212 in a predetermined position. A mechanical interference between electrode body 213 and cartridge body 202 may provide the mechanical retention mechanism. For example, an interference fit between electrode body 213 and body 202 may provide a mechanical retention mechanism. A maximum diameter of electrode body 213 may be greater than diameter D1 so as to create an interference fit. As another example, electrode body 213 may comprise a mechanical structure configured to engage a complementary mechanical structure of inner surface of hollow inner portion 209. The mechanical structure may comprise one of a protruding structure (e.g., lap, finger, snap, ball, etc.) and a recessed structure (e.g., notch, groove, etc.), and the complementary mechanical structure may comprise the other of the protruding structure and the recessed structure. The protruding structure may be configured to break and/or deform, such that the force generated by ignition of propulsion module 208 may overcome the mechanical retention mechanism provided by engagement of the mechanical structure with the complementary mechanical structure. As yet another example, a portion of electrode 212 (such as a portion of spear 214, a portion of first end 215, etc.) may be in contact with cap 204, such that a normal force provided by cap 204 on electrode 212 may serve as a mechanical retention mechanism to position electrode 212 relative to unitary cartridge 200. As a further example, a normal force provided by cap 204 may be transmitted to electrode 212 via a retention body, such as retention body 223. Retention body may be disposed between electrode 212 and cap 204. Retention body 223 may be in contact with cap 204 and a portion of first end 215 of electrode 212. Retention body 223 may comprise a compressible material to accommodate manufacturing tolerances.

In other embodiments, and with reference to FIG. 4D, one or more permanent magnets (e.g., neodymium iron boron magnets, samarium cobalt magnets, etc.) may provide a magnetic retention mechanism to retain electrode 212 relative to unitary cartridge 200. The magnetic retention mechanism between electrode 212 and body 202 may be configured to limit movement of electrode 212 relative to body 202 prior to launch. For example, electrode 212 may comprise first magnet 224 (with brief reference to FIG. 4D). First magnet 224 comprise a shape having a circular cross section, such as a disc, a ring, etc. First magnet 224 may be disposed within electrode body 213, between spear 214 and first end 215, or any other suitable location on electrode 212. First magnet 224 may be attracted to cartridge body 202. The magnetic attraction between first magnet 224 and cartridge body 202 may provide a magnetic retention mechanism between electrode 212 and unitary cartridge 200. As another example, cartridge body 202 may comprise a second magnet, such as second magnet 225 (with brief reference to FIG. 4D). Second magnet 225 may comprise a similar shape to first magnet 224. Second magnet 225 may be configured to attract electrode 212 to retain electrode 212. Second magnet 225 may be configured to attract first magnet 224 of electrode 212 to retain and/or locate electrode 212 relative to cartridge body 202.

Piston 210 may further provide a path for providing the stimulus signal to a wire tether of the electrode 212. Once piston 210 contacts stop 217, electrode 212 may continue its movement away from piston 210 and cartridge body 202. As electrode 212 moves away from piston 210, a wire tether may begin to deploy from electrode body 213. A first end of the wire tether may be coupled (e.g., connected) electrode 212. A second end of the wire tether may be coupled to piston 210. Forward movement of electrode 212 may draw (e.g., deploy) the wire tether from out of cartridge body 202 to extend from electrode 212 to piston 210. Alternatively, the second end of the wire tether may be coupled to the cartridge body 202 instead of the piston 210.

Figure 7:
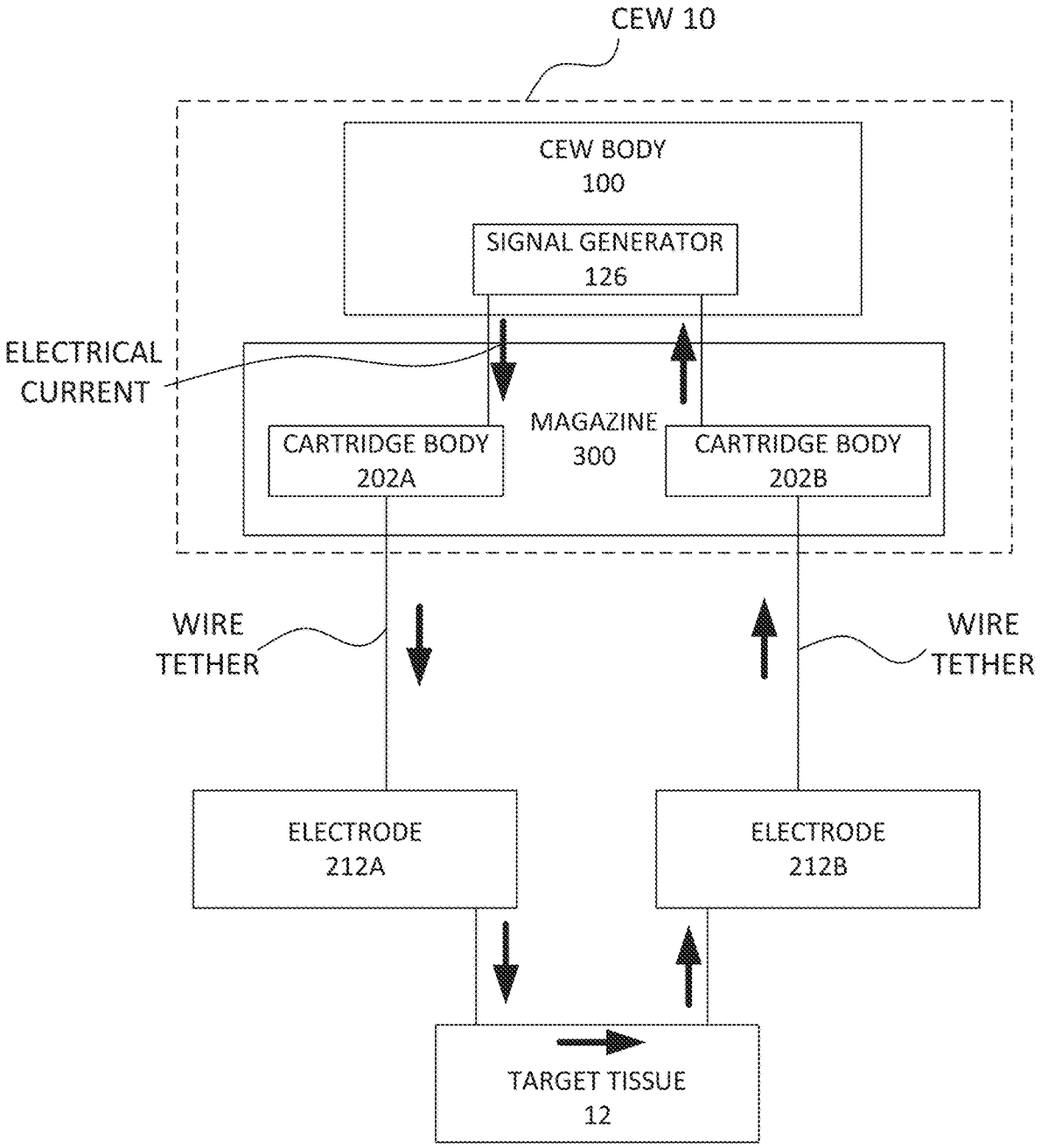
FIG. 7 illustrates a schematic of the conducted electrical weapon with the electrodes engaged on a target according to one or more aspects described herein.

If piston 210 and body 202 are formed of a conductive material, the stimulus signal sent by the signal generator 126 may be applied to electrode body 213 through the cartridge body 202. As shown in FIG. 7, the stimulus signal may travel through cartridge body 202A, including piston 210A, through the wire tether attached to a first electrode 212A, through the first electrode 212A that is coupled to target tissue 12, through the tissue 12 to a second electrode 212B coupled to target tissue 12, through the second electrode 212B, through a second wire tether, and then through cartridge body 202B of the second electrode 212B, including piston 210B, to the signal generator thereby forming a circuit through the target. The stimulus signal through this circuit then immobilizes the target.

In some embodiments, the piston travels distance, L1, defined as the distance from a starting position of piston 210 (e.g., rearward second end 216 of electrode body 213) to piston stop 217 may be configured to alter the kinetic energy imparted on electrode 212 and spear 214. In one embodiment, the piston travel distance, L1 of a starting position of piston 210 (e.g., rearward end of electrode 212) to stop 217 (e.g., piston travel) may be approximately 20 mm, or within a range of 12 mm and 25 mm. For example, using a predetermined amount of pyrotechnic material in the primer 208 in combination with a piston travel distance, L1, of 20 mm may result in launching the electrode 212 from the cartridge body 202 at a speed of about 300 feet per second. In other embodiments, a piston travel distance, L1, may be approximately 4 mm, or within a range of 2 mm and 12 mm. As another example, using the same predetermined amount of pyrotechnic as above in combination with a piston travel distance of 4 mm may result in launching the electrode 212 at a speed of about 200 feet per second, or in combination with a piston travel distance of 2.5 mm launched the electrode at a speed of 150 feet per second. A person skilled in the art may realize that other features may be altered, such as chemistry of primer 208 and position of piston stop 217 of FIG. 4B to further tailor firing characteristics of the electrode 212 from a unitary cartridge 200. Once exiting the cartridge body 202, the velocity of electrode 212 may decrease within a range of 5 and 30 feet per second before striking the target.

In embodiments, piston travel distance L1 and bore distance L2 may be selected to provide predetermined stability and force for launch to electrode 212. The piston travel distance L1 may be selected to allow piston 210 to provide the force for launch with a given amount of pyrotechnic material, while minimizing a size of a cartridge body 202. The bore distance L2 may be selected to impose a direction of motion upon a minimum length of electrode 212 as it is being launched, while also minimizing an amount of friction applied to the electrode 212 by cartridge body 202 and/or minimizing a size of a cartridge body 202.

In embodiments, piston travel distance L1 may be determined relative to bore distance L2. For example, piston travel distance L1 may be equal to bore distance L2. Piston travel distance L1 may be less than bore distance L2, while a value of piston travel distance L1 may be alternately or additionally at least 90% of a value of bore distance L2, at least 80% of the value of bore distance L2, at least 70% of the value of bore distance L2, at least 60% of the value of bore distance L2, or at least 50% of the value of bore distance L2. In embodiments, piston travel distance L1 may be less than bore distance L2, but at least half of bore distance L2. For example, bore distance L2 may be 30 mm, while piston travel distance L1 may be between 30 mm and 15 mm.

In other embodiments, bore distance L2 may be equal or less than piston travel distance L1, while a value of bore distance L2 is alternately or additionally at least 90% of a value of piston travel distance L1, at least 80% of the value of piston travel distance L1, at least 70% of the value of piston travel distance L1, at least 60% of the value of piston travel distance L1, or at least 50% of the value of piston travel distance L1. In embodiments, bore distance L2 may be less than piston travel distance L2, but at least half of piston travel distance L1. For example, piston travel distance L1 may be 30 mm, while bore distance L2 may be between 30 mm and 15 mm.

In embodiments, bore distance L2 may be further selected relative to a length of electrode 212 disposed parallel to a direction along with bore distance L2 is determined. A relative value of bore distance L2 may be selected to impart a preferred degree of direction and friction on the electrode 212 as it is launched. For example, bore distance L2 may be selected such that at least half of electrode 212 is retained in hollow inner portion 209 while piston 210 travels piston travel distance L1. In embodiments, bore distance may be at least 40% of a length of electrode 212, at least 50% of electrode 212, or at least 60% of electrode 212. By selecting bore distance L2 relative to the length of electrode 212, electrode 212 may be guided from unitary cartridge 200 upon launch in a controlled manner, while minimizing a size of a cartridge body 202.

In embodiments, bore distance L2 may include a second predetermined distance, relative to a first predetermined piston travel distance L1. Bore distance L2 may be at least 5 mm, at least 10 mm, at least 15 mm, at least 20 mm, at least 25 mm, or at least 30 mm. In one embodiment, the bore distance may be approximately 20 mm, or within a range of 10 mm and 30 mm. In other embodiments, a bore distance, L2, may be approximately 6 mm, or within a range of 2 mm and 12 mm.

As discussed above, the range of a CEW 10 may be limited by the length of the wire tethers. The electrode body 213 may comprise a hollow portion that includes a wire tether. The wire tether may be electrically coupled at a first end to the spear 214 and at a second end to the piston 210. The wire tether may provide an electrical connection between the body 100 and the spear 214 to deliver the stimulus signal to the target. The cartridge body 202 may be electrically conductive such that the cartridge body 202 may transmit an electrical charge from the body 100 to the piston 210 through the wire tether to the spear 214 and into the target.

In some embodiments, the length of a deployed wire tether between the unitary cartridge 200 and a launched electrode 212 may be approximately 20 feet. While in other embodiments, the length of the wire tether may be approximately 40 feet, or approximately 60 feet. In some embodiments, the length of the wire tether may be within a range of 8 feet to 20 feet, or within a range of 8 feet to 40 feet, or within a range of 8 feet to 60 feet.

Unlike existing cartridges that typically comprise a plurality of electrodes, the unitary cartridge 200 may comprise a unitary electrode 212 configured to launch via a unitary cartridge body 202. Significant practical advantages may be afforded by such an apparatus. First, by directly coupling a single propulsion module 208 with a unitary electrode 212 may remove the need for a manifold to direct expanding gas to a plurality of electrodes. Further, removing a manifold from a cartridge and using a piston driver 210 significantly reduces the size of unitary cartridge 200. In the embodiments disclosed herein, a polymorphic CEW 10 may have a magazine 300 configured to accommodate more than 12 single electrode unitary cartridges 200 in the same footprint as a traditional CEW that may only accommodate two dual electrode cartridges. However, a polymorphic CEW 10 may also be more capable than a traditional CEW in order to individually control the polarity and charge characteristics of each probe of each unitary cartridge 200 of a magazine 300.

In some embodiments, the magazine 300 may comprise various pluralities of unitary cartridges 200, creating different firing characteristics, such as but not limited to range, velocity, propulsion type, electrode exit angle, and/or barb geometry. Examples of various embodiments of magazine 300 configurations are described below.

For the magazine embodiment illustrated in FIGS. 5A-5D, the features are referred to using similar reference numerals under the "4xx" series of reference numerals, rather than "3xx" as used in the magazine embodiments of FIGS. 1A-1E. Accordingly, certain features of the magazine 400 that were already described above with respect to magazine 300 of FIGS. 1A-1E may be described in lesser detail, or may not be described at all. FIGS. 5A-5D show magazine 400 may comprise a plurality of firing tubes 416 oriented along different axes. Magazine 400 may interchangeably engage with the body 100 to form the CEW 10. FIGS. 5A-5D depict magazine 400 comprising 12 firing tubes 416 configured to launch unitary cartridges 200 at a plurality of angles. For example, the firing tubes 416 may be oriented in an array of 4 rows by 3 columns (4×3 array). Each of the firing tubes 416A in the top row of firing tubes 416A of magazine 400 may have an axis 422 oriented parallel with one another and also oriented substantially parallel with axis 115 defined by sights 112, 114 of the body 100. Each of the firing tubes 416B in the second row of firing tubes 416B of magazine 400 may have an axis 424 oriented parallel with one another and also oriented substantially parallel with the axis 422. Each of the firing tubes 416C in the third row of firing tubes 416 of magazine 400 may have an axis 426 oriented parallel with one another and also oriented to be at an acute angle 430 with the axes 422 of the firing tubes 416A of the first row. In some embodiments, the angle 430 may be approximately 3 degrees, or within a range of 2 and 4 degrees, or within a range of 2 degrees and 6 degrees, or in some cases, within a range of 0 degrees and 20 degrees. Each of the firing tubes 416D in the bottom row of firing tubes 416 of magazine 400 may have an axis 428 oriented parallel with one another and also oriented to be at an acute angle 432 with the axes 422 of the firing tubes 416A of the first row where the angle 432 is greater than angle 430. In some embodiments, the angle 432 may be approximately 12 degrees, or within a range of 10 and 14 degrees, or within a range of 8 degrees and 16 degrees, or in some cases, within a range of 0 degrees and 20 degrees. Angle 432 may be greater than angle 430, such that the axis 428 diverges from axis 426 and also diverges from axes 422, 424. While magazine 400 shows a particular arrangement of firing tubes 416A, 416B, 416C, and 416D shown in FIGS. 5B-5D, a person skilled in the art will realize that numerous alternate configurations may exist.

Figure 6A:
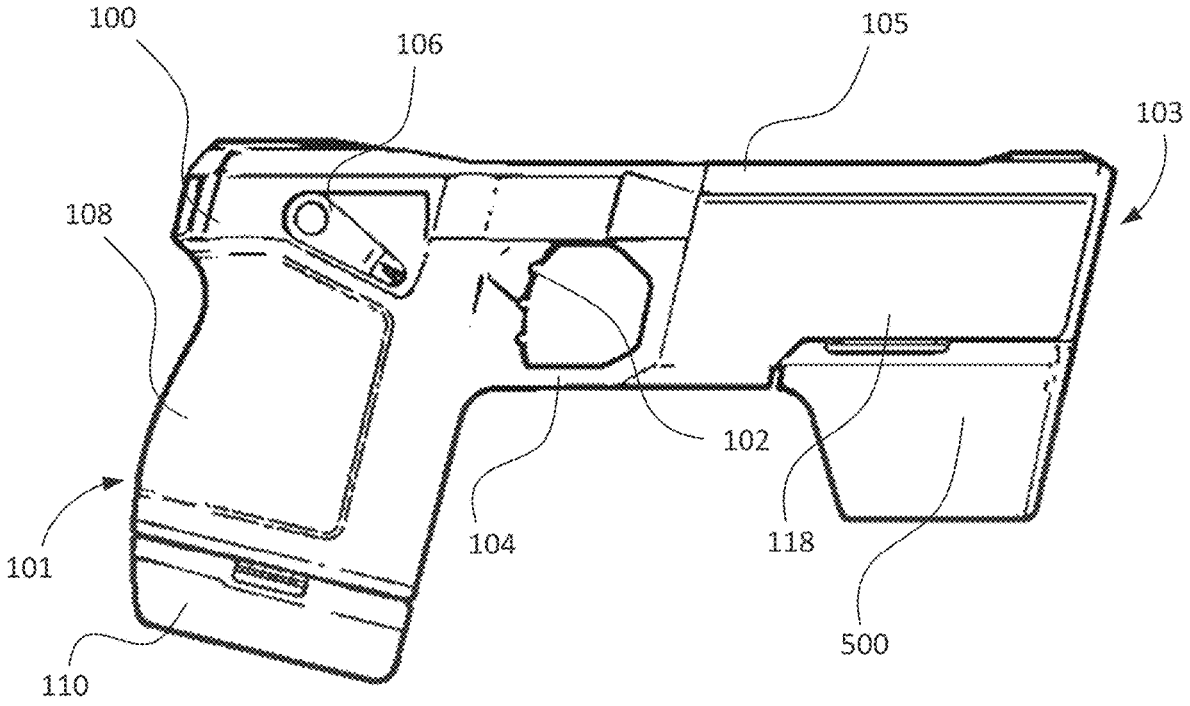
FIG. 6A illustrates a side view of a conducted electrical weapon system with a magazine engaged according to one or more aspects described herein.
Figure 6B:
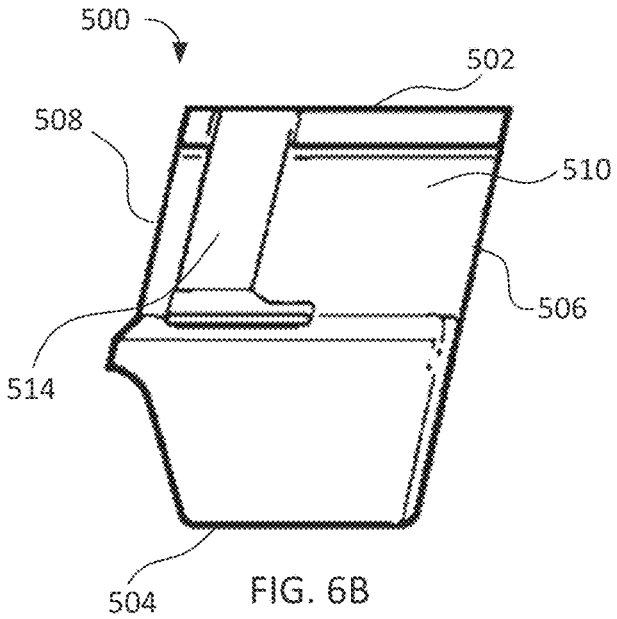
FIG. 6B illustrates a side view of the magazine of the conducted electrical weapon system illustrated in FIG. 6A according to one or more aspects described herein.
Figure 6C:
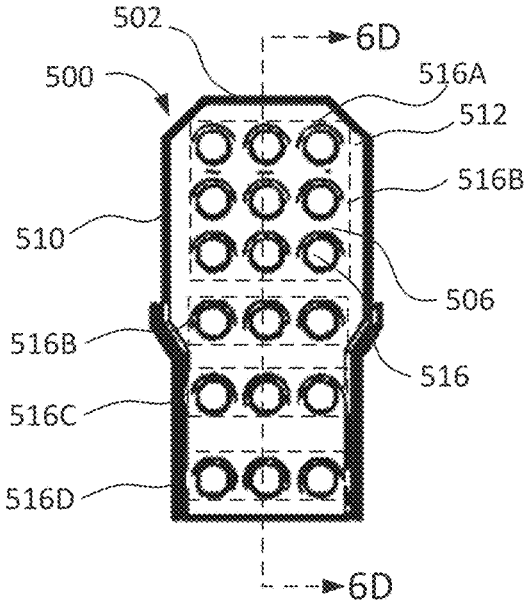
FIG. 6C illustrates a front view of the magazine of FIG. 6B according to one or more aspects described herein.
Figure 6D:
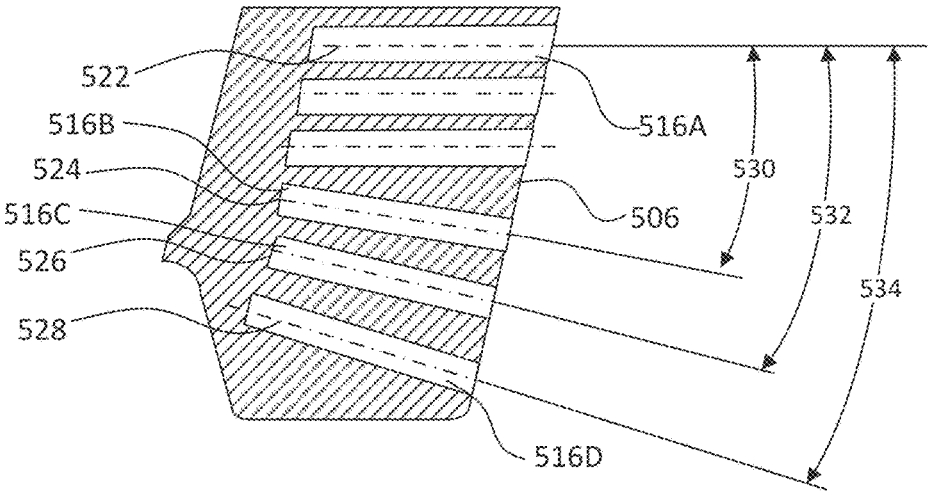
FIG. 6D illustrates a side cross-sectional view of the magazine of FIG. 6B according to one or more aspects described herein.

For the magazine embodiment illustrated in FIGS. 6A-6D, the features are referred to using similar reference numerals under the "5xx" series of reference numerals, rather than "3xx" as used in the magazine embodiments of FIGS. 1A-1E. Accordingly, certain features of the magazine 500 that were already described above with respect to magazine 300 of FIGS. 1A-1E may be described in lesser detail, or may not be described at all. FIGS. 6A-6D show magazine 500 may comprise a plurality of firing tubes 516 oriented along different axes. Magazine 500 may interchangeably engage with the body 100 to for the CEW 10 similar to magazines 300 and 400. FIGS. 6A-6D depict a magazine configuration comprising 18 firing tubes 516 configured to launch unitary cartridges 200 at a plurality of angles. For example, FIGS. 6A-6D illustrate magazine 500 comprising 18 firing tubes 316 configured to launch a plurality of unitary cartridges in a plurality of directions. FIG. 6A illustrates an embodiment wherein a polymorphic CEW body 100 is releasably engaged with magazine 500 via a magazine bay 118. In the exemplary embodiment, magazine 500 may comprise 18 firing tubes grouped into a plurality of groups, where each group of firing tubes 516 may have an axis oriented at a different direction. For example, the firing tubes 516 may be oriented in an array of 6 rows by 3 columns (6×3 array) that are arranged in four groups 516A, 516B, 516C, 516D. Each of the firing tubes 516A in the first group of magazine 500 may have an axis 522 oriented parallel with one another and also oriented substantially parallel with axis 115 defined by sights 112, 114 of the body 100. Each of the firing tubes 516 in the second group 516B below the first group of magazine 500 may have an axis 524 oriented parallel with one another and also oriented at an acute angle 530 with the axes 522 of the firing tubes 516 of the first group 516A. In some embodiments, the angle 530 may be approximately 3 degrees, or within a range of 2 and 4 degrees, or within a range of 2 degrees and 6 degrees, or within a range of 0 degrees and 20 degrees. Each of the firing tubes 516 in the third group 516C of magazine 500 may have an axis 526 oriented parallel with one another and also oriented to be at an acute angle 532 with the axes 522 of the firing tubes 516 of the first group 516A. In some embodiments, the angle 532 may be approximately 12 degrees, or within a range of 10 and 14 degrees, or within a range of 8 degrees and 16 degrees, or within a range of 0 degrees and 20 degrees. Each of the firing tubes 516 in the fourth group of firing tubes 516D of magazine 500 may have an axis 528 oriented parallel with one another and also oriented to be at an acute angle 534 with the axes 522 of the firing tubes 516 of the first group 516A. In some embodiments, the angle 534 may be approximately 16 degrees, or within a range of 14 and 18 degrees, or within a range of 12 degrees and 20 degrees, or within a range of 0 degrees and 20 degrees. Angle 534 may be greater than angles 530, 532, such that the axis 528 diverges from axis 526 and also diverges from axes 422, 424. In addition, angle 532 may be greater than angle 530, such that axis 526 diverges from axes 422, 424. While magazine 500 shows a particular arrangement of firing tubes groups 516A, 516B, 516C, and 516D shown in FIGS. 6B-6D, a person skilled in the art will realize that numerous alternate configurations may exist.

As discussed above, processor 120 of polymorphic CEW 10 may be configured to aid in determining which electrode 212 to fire. The processor 120 may receive data regarding the distance from the CEW 10 to the target 12 and use this data to determine which electrodes 212 to fire to achieve the optimal spacing to induce NMI when the stimulus signal is activated. For instance, for a target 12 positioned at a first predetermined distance from the CEW 10, the processor 120 may select to fire an electrode 212 or plurality of electrodes 212 from a firing tube 316, 416, 516 arranged at a substantially parallel to axis 115 (zero degrees) of the body 100. In some instances, the first predetermined distance may be within a range of 15 feet to 50 feet (4.6 meters to 15.2 meters). In other instances, such as a second predetermined distance, the processor 120 may fire a first electrode 212A from a first row of firing tubes, such as an upper row of firing tubes (parallel to axis 115), and a second electrode 212B from a second row of firing tubes that are arranged with an axis that is at an acute angle to axis 115, such as one of the firing tubes 416C, 416D, 516B, 516C, 516D in a lower low of tubes, such that when the first electrode 212A and the second electrode 212B are coupled to the target 12, they will have an optimal spacing to induce NMI when the stimulus signal is sent. For example, the second predetermined distance may be within a range of 1 foot to 20 feet (0.3 meters to 6.1 meters).

While the magazine configurations depicted in FIGS. 1A-1E, and 5A-6D depict various embodiments of the number of unitary cartridges and firing tube arrangements, the illustrated embodiments should not restrict this disclosure and are merely representations of a few example implementations. The foregoing description discusses preferred embodiments of the present invention, which may be changed or modified without departing from the scope of the present invention as defined in the claims. Examples listed in parentheses may be used in the alternative or in any practical combination. As used in the specification and claims, the words 'comprising', 'comprises', 'including', 'includes', 'having', and 'has' introduce an open-ended statement of component structures and/or functions. In the specification and claims, the words 'a' and 'an' are used as indefinite articles meaning 'one or more'. While for the sake of clarity of description, several specific embodiments of the invention have been described, the scope of the invention is intended to be determined by the claims as set forth below. In the claims, the term "provided" is used to definitively identify an object that not a claimed element of the invention but an object that performs the function of a workpiece that cooperates with the claimed invention. A person of ordinary skill in the art will appreciate that this disclosure includes any practical combination of the structures and methods disclosed.

In various embodiments, and with reference to FIG. 3A, processor 120 may be electrically and/or electronically coupled to signal generator 126. Processor 120 may be configured to transmit or provide control signals to signal generator 126 in response to detecting an activation event of trigger 102. Multiple control signals may be provided from processor 120 to signal generator 126 in series. In response to receiving the control signal, signal generator 126 may be configured to perform various functions and/or operations.

In various embodiments, signal generator 126 may be configured to receive one or more control signals from processor 120. Signal generator 126 may provide an ignition signal to unitary cartridge 200 based on the control signals. Signal generator 126 may be electrically and/or electronically coupled to processor 120 and/or unitary cartridge 200. Signal generator 126 may be electrically coupled to power source 110. Signal generator 126 may use power received from power source 110 to generate an ignition signal. For example, signal generator 126 may receive an electrical signal from power source 110 that has first current and voltage values. Signal generator 126 may transform the electrical signal into an ignition signal having second current and voltage values. The transformed second current and/or the transformed second voltage values may be different from the first current and/or voltage values. The transformed second current and/or the transformed second voltage values may be the same as the first current and/or voltage values. Signal generator 126 may temporarily store power from power source 110 and rely on the stored power entirely or in part to provide the ignition signal. Signal generator 126 may also rely on received power from power source 110 entirely or in part to provide the ignition signal, without needing to temporarily store power.

Signal generator 126 may be controlled entirely or in part by processor 120. In various embodiments, signal generator 126 and processor 120 may be separate components (e.g., physically distinct and/or logically discrete). Signal generator 126 and processing circuit 120 may be a single component. For example, a control circuit within body 100 may at least include signal generator 126 and processor 120. The control circuit may also include other components and/or arrangements, including those that further integrate corresponding function of these elements into a single component or circuit, as well as those that further separate certain functions into separate components or circuits.

Signal generator 126 may be controlled by the control signals to generate an ignition signal having a predetermined current value or values. For example, signal generator 126 may include a current source. The control signal may be received by signal generator 126 to activate the current source at a current value of the current source. An additional control signal may be received to decrease a current of the current source. For example, signal generator 126 may include a pulse width modification circuit coupled between a current source and an output of the control circuit. A second control signal may be received by signal generator 126 to activate the pulse width modification circuit, thereby decreasing a non-zero period of a signal generated by the current source and an overall current of an ignition signal subsequently output by the control circuit. The pulse width modification circuit may be separate from a circuit of the current source or, alternatively, integrated within a circuit of the current source. Various other forms of signal generators 126 may alternatively or additionally be employed, including those that apply a voltage over one or more different resistances to generate signals with different currents. In various embodiments, signal generator 126 may include a high-voltage module configured to deliver an electrical current having a high voltage. In various embodiments, signal generator 126 may include a low-voltage module configured to deliver an electrical current having a lower voltage (e.g., low voltage), such as, for example, 2,000 volts.

Responsive to receipt of a signal indicating activation of trigger 102, a control circuit 322 (with brief reference to FIG. 3A), provides an ignition signal to unitary cartridge 200. For example, signal generator 126 may provide an electrical signal as an ignition signal to unitary cartridge 200 in response to receiving a control signal from processor 120. In various embodiments, the ignition signal may be separate and distinct from a stimulus signal. For example, a stimulus signal in CEW 10 may be provided to a different circuit within unitary cartridge 200, relative to a circuit to which an ignition signal is provided. Signal generator 126 may be configured to generate a stimulus signal. In various embodiments, a second, separate signal generator, component, or circuit (not shown) within body 100 may be configured to generate the stimulus signal. Signal generator 126 may also provide a ground signal path for unitary cartridge 200, thereby completing a circuit for an electrical signal provided to unitary cartridge 200 by signal generator 126. The ground signal path may also be provided to unitary cartridge 200 by other elements in body 100, including power source 110 (with brief reference to FIG. 3A).

In embodiments, and responsive to an input received via trigger 102, a control circuit 322 (with brief reference to FIG. 3A), selectively provides an ignition signal to less than all firing tubes of a plurality of firing tubes 316. The control circuit 322 may be configured to provide the ignition signal to a subset of firing tubes in a column of firing tubes in magazine 300. For example, the control circuit may be configured to provide the ignition signal to less than all of three firing tubes in a column of firing tubes. The control circuit may be configured to provide the ignition signal to at least two firing tubes of the plurality of firing tubes in accordance with a distance to a target, a predetermined sequence of firing tubes, or an input received via an environmental sensor or positional sensor. Magazine 300 may include an ignition circuit for each firing tube of the plurality of firing tubes by which magazine 300 is configured to launch less than all electrodes housed in magazine 300, wherein the launch is further determined in accordance with the ignition signal provided by control circuit 322. In embodiments, control circuit 322 may sequentially provide the ignition signal to different sets of less than all firing tubes in the plurality of firing tubes, wherein the different sets may include firing tubes in same or different columns of firing tubes in magazine 300.

In various embodiments, CEW 10 may be configured to send an ignition signal to a single unitary cartridge 200, to cause a single propulsion module 208 to ignite. The single unitary cartridge 200 may be one unitary cartridge of a plurality of unitary cartridges in a same magazine coupled to CEW 10. Each unitary cartridge in the plurality of unitary cartridges, including the single unitary cartridge 200, may be configured to receive a different ignition signal from CEW 10. CEW 10 may provide a respective, individual ignition signal to each unitary cartridge in the same magazine, wherein the respective, individual ignition signal may be received distinctly by each unitary cartridge in the magazine. A first ignition signal provided to single unitary cartridge 200 may be separate from another ignition signal provided to another unitary cartridge in the plurality of unitary cartridges, including one or more other ignition signals respectively provided to each other unitary cartridge in the plurality of unitary cartridges. Each unitary cartridge in the plurality of unitary cartridges may be electrically coupled in parallel to signal generator 126 of CEW 10. When unitary cartridge 200 is engaged with CEW 10, CEW 10 may form a closed electrical circuit with a single propulsion module 208.

Figure 8B:
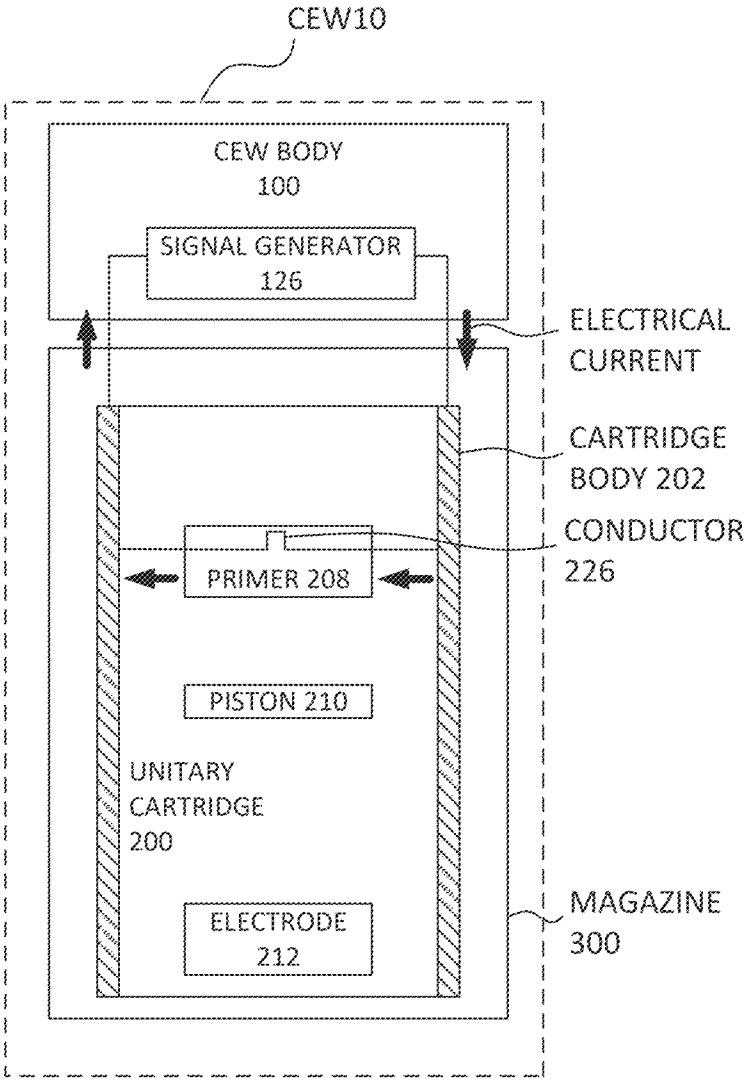
FIG. 8B illustrates a schematic of an alternate embodiment of an ignition circuit of a conducted electrical weapon and unitary cartridge according to one or more aspects described herein.
Figure 8A:
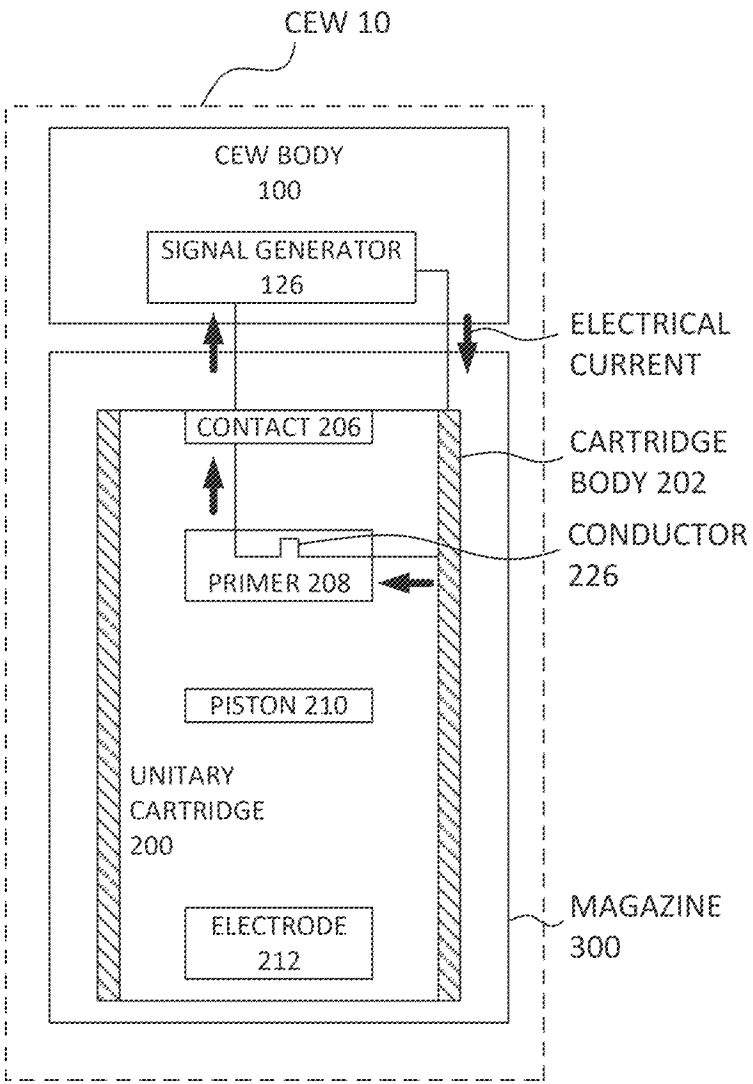
FIG. 8A illustrates a schematic of an ignition circuit of a conducted electrical weapon and unitary cartridge according to one or more aspects described herein.

In various embodiments, primer 208 may comprise a solid conductive structure, such as conductor 226 (with brief reference to FIG. 8A). Flow of an electrical signal through primer 208 may cause conductor 226, to heat up, thereby igniting the pyrotechnic material inside primer 208. Conductor 226 may comprise metal or an alloy. Conductor 226 may pass through a portion of primer 208.

In some embodiments, and with reference to FIG. 8A, an electrical signal may travel through cartridge body 202, through primer 208, and then through contact 206, to signal generator 126 thereby forming a closed circuit. Conductor 226 may be directly coupled with contact 206 and cartridge body 202. Conductor 226 may conductively couple contact 206 and cartridge body 202. Conductor 226 may be coupled with contact 206 and cartridge body 202 via solid conductive medium. Contact 206 may be grounded and a voltage having a positive or negative polarity may be applied to cartridge body 202 to induce a current to flow through conductor 226 to contact 206, causing primer 208 to ignite. An electrical path for an ignition signal may include contact 206, primer 208, conductor 226, and cartridge body 202.

In other embodiments, and with reference to FIG. 8B, an electrical signal may travel through cartridge body 202, through primer 208, and then through cartridge body 202, to signal generator 126 thereby forming a closed circuit. Conductor 226 may be directly coupled with cartridge body 202. A portion of cartridge body 202 may be grounded and a voltage having a positive or negative polarity may be applied to cartridge body 202 to induce a current to flow conductor 226, causing primer 208 to ignite. An electrical path for an ignition signal may include primer 208, conductor 226, and cartridge body 202.

In embodiments, a symmetrical portion of cartridge body 202 may be conductive, enabling cartridge body 202 to contact an electrode of magazine 300 in various rotational orientations of cartridge body 202 relative to magazine 300. The symmetrical portion may include an entire portion of cartridge body 202. Each outer surface of cartridge body 202 may be conductive. In embodiments, the symmetrical portion may include at least a band of cartridge body 202 that circumscribes cartridge body 202 perpendicular to a central axis of cartridge body 202. The symmetrical portion may further include two or more electrically isolated portions of cartridge body 202, wherein a signal may be received by the cartridge body 202 at a first portion of the two or more electrically isolated portions and transmitted from the cartridge body 202 at a second portion of the two or more electrically isolated portions. For example, a first portion of the cartridge body 202 may be configured to be coupled to a ground electrode of magazine 300, while a second, electrically isolated portion of cartridge body may be configured to receive an ignition signal as discussed above with respect to FIG. 8B. The first portion and second portion may be symmetrically positioned about cartridge body 202 as illustrated in FIG. 8B.

Aspects of this disclosure relate to a magazine for a conducted electrical weapon ("CEW"). In a first example embodiment, a magazine body may include a top surface, a bottom surface opposing the top surface, a rear surface extending between the top surface and the bottom surface, a front surface extending between the top surface and the bottom surface, a first side surface extending between the front surface and the rear surface, and a second side surface extending between the front surface and the rear surface. The magazine may also comprise a plurality of firing tubes integrated with the magazine body, where each firing tube of the plurality of firing tubes is contiguous with the front surface, and where each firing tube of the plurality of firing tubes is configured to launch an electrode toward a target.

In a second example embodiment of a magazine, the magazine may comprise a magazine body including a front surface; three firing tubes, where each firing tube of the three firing tubes are contiguous with the front surface; and an electrode disposed within each firing tube of the three firing tubes, where each electrode is configured to be launched from its respective firing tube.

A third example embodiment of a magazine may include a magazine of any one of the preceding example embodiments, where each firing tube of the plurality of firing tubes are oriented parallel with one another.

A fourth example embodiment of a magazine may include a magazine of any one of the preceding example embodiments, where the magazine body comprises three firing tubes.

A fifth example embodiment of a magazine may include a magazine of any one of the preceding example embodiments, where three firing tubes are arranged in a column.

A sixth example embodiment of a magazine may include a magazine of any one of the preceding example embodiments, where a first pair of firing tubes of three firing tubes are oriented to achieve a minimum electrode spread at a first range, and a second pair of firing tubes of the three firing tubes are oriented to achieve the minimum electrode spread at a second range.

A seventh example embodiment of a magazine may include a magazine of any one of the preceding example embodiments, where a first firing tube of three firing tubes is orientated at a first angle relative to a second firing tube of the three firing tubes, a third firing tube of the three firing tubes is orientated at a second angle relative to the first firing tube, and where the first angle is greater than the second angle.

An eighth example embodiment of a magazine may include a magazine of any one of the preceding example embodiments, where a first firing tube of three firing tubes is orientated parallel to a second firing tube of the three firing tubes, and a third firing tube of the three firing tubes is orientated at an angle relative to the first firing tube.

A ninth example embodiment of a magazine may include a magazine of any one of the preceding example embodiments, where the plurality of firing tubes comprise a first column of firing tubes oriented parallel to a second column of firing tubes, where the first column of firing tubes comprises a first set of three firing tubes, and where the second column comprises a second set of three firing tubes.

A tenth example embodiment of a magazine may include a magazine of any one of the preceding example embodiments, where a distance between each firing tube of the plurality of firing tubes is less than 0.25 inches (0.635 centimeters).

A eleventh example embodiment of a magazine may include a magazine of any one of the preceding example embodiments, where a first pair of firing tubes of three firing tubes are oriented at a first angle, and a second pair of firing tubes of the three firing tubes are oriented at a second angle, wherein the second angle is greater than the first angle.

A twelfth example embodiment of a magazine may include a magazine of any one of the preceding example embodiments, where the first pair of firing tubes of three firing tubes and the second pair of firing tubes of the three firing tubes are tangent with a common plane.

Another aspect of this disclosure relates to a conducted electrical weapon ("CEW"). In a first example embodiment of a conducted electrical weapon, the conducted electrical weapon may comprise a conducted electrical weapon body that may include a handle portion at a first end configured to be grasped by a hand of a user, an upper member extending in a substantially front-to-rear direction from the handle portion to a second end opposite the first end, a magazine bay positioned beneath the upper member, a trigger positioned between the handle portion and the magazine bay, and a control circuit. The conducted electrical weapon may also comprise a magazine comprising a magazine body including a front surface and a rear surface, where the rear surface opposes the front surface, and a plurality of firing tubes, where each firing tube of the plurality of firing tubes comprises an opening contiguous with the front surface, and where each firing tube of the plurality of firing tubes are configured to house a unitary cartridge that comprises an electrode. The control circuit may be configured to selectively provide an ignition signal to less than all of the plurality of firing tubes in response to an input received via the trigger.

A second example embodiment of a conducted electrical weapon may include a conducted electrical weapon of any of the preceding example embodiments, where the plurality of firing tubes comprises three firing tubes arranged in a column in the front surface, and wherein the control circuit is configured to provide the ignition signal to less than all of the three firing tubes.

A third example embodiment of a conducted electrical weapon may include a conducted electrical weapon of any of the preceding example embodiments, where the control circuit is configured to provide the ignition signal to at least two firing tubes of the plurality of firing tubes in accordance with a distance to a target.

A fourth example embodiment of a conducted electrical weapon may include a conducted electrical weapon of any of the preceding example embodiments, where the opening of each firing tube of the plurality of firing tubes is in fluid communication with an environment external to the magazine.

A fifth example embodiment of a conducted electrical weapon may include a conducted electrical weapon of any of the preceding example embodiments, where an inner diameter of the opening of each firing tube of the plurality of firing tubes is less than an outer diameter of each of the unitary cartridges.

A sixth example embodiment of a conducted electrical weapon may include a conducted electrical weapon of any of the preceding example embodiments, where a first orientation of a first firing tube of the plurality of firing tubes relative to a second firing tube of the plurality of firing tubes is configured to provide a minimum electrode spacing at a first distance, and a second orientation of the first firing tube of the plurality of firing tubes relative to a third firing tube of the plurality of firing tubes is configured to provide the minimum electrode spacing at a second distance, wherein the second distance is greater than the first distance.

A seventh example embodiment of a conducted electrical weapon may include a conducted electrical weapon of any of the preceding example embodiments, where each firing tube of the plurality of firing tubes are oriented parallel to each other.

An eighth example embodiment of a conducted electrical weapon may include a conducted electrical weapon of any of the preceding example embodiments, where the magazine bay and magazine are configured to couple the plurality of firing tubes at fixed positions relative to the conducted electrical weapon body.

After considering this disclosure, it will be apparent to one skilled in the art how the invention is implemented in various alternative embodiments and alternative applications. However, although various embodiments of the present invention will be described herein, it is understood that these embodiments are presented by way of example only, and not limitation. As such, this description of various alternative embodiments should not be construed to limit the scope or breadth of the present invention. Furthermore, statements of advantages or other aspects apply to specific exemplary embodiments, and not necessarily to all embodiments covered by the claims.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A magazine comprising:

a body comprising a front surface opposite a rear surface; and a plurality of firing tubes disposed in the body and extending longitudinally between the front surface and the rear surface, wherein each firing tube of the plurality of firing tubes comprises a front firing tube end opposite a rear firing tube end, wherein the front firing tube end comprises a smaller diameter than the rear firing tube end, and wherein a firing tube of the plurality of firing tubes comprises a shelf protruding inward from an inner surface of the firing tube.

2. The magazine of claim 1, wherein the smaller diameter of the front firing tube end is configured to cooperate with a cartridge to limit translation of the cartridge.

3. The magazine of claim 1, wherein a diameter of each firing tube of the plurality of firing tubes varies from the rear firing tube end to the front firing tube end.

4. The magazine of claim 1, wherein a diameter of each firing tube of the plurality of firing tubes tapers from the rear firing tube end to the front firing tube end.

5. The magazine of claim 1, wherein the front firing tube end defines a front firing tube opening on the front surface, and wherein the rear firing tube end defines a rear firing tube opening on the rear surface.

6. The magazine of claim 5, wherein the front firing tube opening comprises a first diameter, wherein the rear firing tube opening comprises a second diameter, and wherein the first diameter is smaller than the second diameter.

7. The magazine of claim 1, wherein the shelf is adjacent the front firing tube end.

8. The magazine of claim 1, wherein the shelf is configured to limit translation of a cartridge along a longitudinal axis of the firing tube.

9. The magazine of claim 1, wherein a first diameter of the shelf is less than a second diameter of the rear firing tube end.

10. A conducted electrical weapon comprising:

a handle comprising a magazine bay; and a magazine configured to removably couple to the magazine bay, the magazine comprising:

a body comprising a front surface opposite a rear surface; and a plurality of firing tubes disposed in the body and extending longitudinally between the front surface and the rear surface, wherein each firing tube of the plurality of firing tubes comprises a front firing tube end opposite a rear firing tube end, wherein the front firing tube end comprises a smaller diameter than the rear firing tube end, wherein the front firing tube end defines a front firing tube opening on the front surface, and wherein the rear firing tube end defines a rear firing tube opening on the rear surface.

11. The conducted electrical weapon of claim 10, wherein the magazine comprises a first length, wherein each firing tube of the plurality of firing tubes comprise a second length, and wherein the first length is equal to the second length.

12. The conducted electrical weapon of claim 10, wherein a diameter of each firing tube of the plurality of firing tubes varies from the rear firing tube end to the front firing tube end.

13. The conducted electrical weapon of claim 10, wherein a firing tube of the plurality of firing tubes comprises a shelf protruding inward from an inner surface of the firing tube.

14. The conducted electrical weapon of claim 13, wherein a first diameter of the shelf is less than a second diameter of the rear firing tube end.

15. The conducted electrical weapon of claim 10, wherein the plurality of firing tubes are arranged in an array of columns, and wherein columns in the array of columns are disposed in an offset pattern.

16. The conducted electrical weapon of claim 10, wherein the magazine and the plurality of firing tubes are stationary relative to the handle upon engagement of the magazine with the magazine bay.

17. The conducted electrical weapon of claim 10, wherein each firing tube of the plurality of firing tubes is in a fixed position within the magazine.

18. The conducted electrical weapon of claim 10, wherein each firing tube of the plurality of firing tubes is positioned in parallel within the body.

19. The conducted electrical weapon of claim 10, wherein a first volume of the magazine bay is less than a second volume of the magazine.

20. The conducted electrical weapon of claim 13, wherein the shelf is configured to limit translation of a cartridge along a longitudinal axis of the firing tube.

* * * * *